US007931263B2

(12) United States Patent
Takahagi et al.

(10) Patent No.: US 7,931,263 B2
(45) Date of Patent: Apr. 26, 2011

(54) IMAGE FORMING SYSTEM HAVING ENHANCED FUNCTIONALITY

(75) Inventors: Hiroshi Takahagi, Tokyo (JP); Yutaka Shoji, Tokyo (JP); Junji Shirakawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 137 days.

(21) Appl. No.: 11/806,747

(22) Filed: Jun. 4, 2007

(65) Prior Publication Data

US 2007/0296135 A1 Dec. 27, 2007

(30) Foreign Application Priority Data

Jun. 5, 2006 (JP) ..... 2006-155871

(51) Int. Cl.
*B65H 5/22* (2006.01)

(52) U.S. Cl. ..... 271/3.01; 271/3.14

(58) Field of Classification Search ..... 271/3.01, 271/3.14

See application file for complete search history.

(56) References Cited

U.S. PATENT DOCUMENTS

| | | | | |
|---|---|---|---|---|
| 5,162,846 | A * | 11/1992 | Cahill | 399/125 |
| 5,200,790 | A * | 4/1993 | Irie et al. | 399/17 |
| 5,206,681 | A * | 4/1993 | Otomo et al. | 399/411 |
| 5,220,393 | A * | 6/1993 | Otomo | 399/125 |
| 5,732,307 | A | 3/1998 | Yoshizuka et al. | |
| 5,918,876 | A | 7/1999 | Maruyama et al. | |
| 6,134,404 | A | 10/2000 | Iwai et al. | |
| 6,259,872 | B1 | 7/2001 | Fukunaga et al. | |
| 6,510,301 | B2 * | 1/2003 | Tanaka | 399/125 |
| 7,422,209 | B2 | 9/2008 | Hashimoto | |
| 2002/0125626 | A1 * | 9/2002 | Ogita et al. | 271/3.01 |
| 2003/0077095 | A1 | 4/2003 | Conrow | |
| 2004/0155395 | A1 | 8/2004 | Milillo et al. | |
| 2005/0035539 | A1 | 2/2005 | Hashimoto | |
| 2005/0286929 | A1 * | 12/2005 | Park | 399/124 |
| 2006/0039729 | A1 | 2/2006 | Mandel et al. | |

FOREIGN PATENT DOCUMENTS

| | | |
|---|---|---|
| EP | 0501469 | 3/1996 |
| JP | 61-181030 | 11/1986 |
| JP | 06-250455 | 9/1994 |
| JP | 7-223756 | 8/1995 |

(Continued)

OTHER PUBLICATIONS

Extended Search Report for corresponding European Application No. 07 109 534.3 dated Oct. 19, 2007.

(Continued)

*Primary Examiner* — Stefanos Karmis
*Assistant Examiner* — Michael C McCullough
(74) *Attorney, Agent, or Firm* — Harness, Dickey & Pierce, P.L.C.

(57) ABSTRACT

A sheet feed apparatus, e.g., coupled to an image forming apparatus, can include: a main frame; a storage unit mounted on the main frame and configured with a capacity to store a large quantity of sheet-like material; a transporter mounted on the main frame and configured to supply the sheet-like material to the image forming apparatus; an additional unit adapted to be mounted on the main frame and operable to enhance a functionality of at least one of the sheet feed apparatus and an image forming apparatus; and a supporting frame mounted on the main frame in place of the additional unit, and further adapted such that the additional unit is mountable thereon; the additional unit being mounted on the supporting frame.

20 Claims, 18 Drawing Sheets

FOREIGN PATENT DOCUMENTS

| | | |
|---|---|---|
| JP | 8-239130 | 9/1996 |
| JP | 2005-035709 | 2/2005 |
| JP | 2005-047152 | 2/2005 |
| JP | 2005-049392 | 2/2005 |
| JP | 2005-064702 | 3/2005 |
| JP | 2005-154055 | 6/2005 |
| JP | 2005-239351 | 9/2005 |
| JP | 2005-258303 | 9/2005 |
| JP | 2006-016188 | 1/2006 |

OTHER PUBLICATIONS

European Communication dated Jul. 2, 2009.

Office Action dated Jan. 24, 2011 in corresponding European Patent Application No. 07109534.3.

* cited by examiner

IMAGE FORMING SYSTEM HAVING ENHANCED FUNCTIONALITY

PRIORITY STATEMENT

The present patent application claims priority under 35 U.S.C. §119 upon Japanese patent application No. 2006-155871, filed in the Japan Patent Office on Jun. 5, 2006, the content and disclosure of which is hereby incorporated by reference herein in its entirety.

TECHNICAL FIELD

The present disclosure generally relates to an image forming system having an apparatus for enhancing functionality of image forming system.

BACKGROUND

A sheet feed apparatus, which can store a large number of sheets, may be attached to an image forming apparatus such as printing machine and copying machine, to supply sheets to the image forming apparatus.

In general, an image forming apparatus (e.g., high-speed printing/copying machine) may include a sheet feed section, which can store a large quantity of sheets, or attach a sheet feed table at a lower part of the image forming apparatus to realize a greater capacity for copying/printing operations with a relatively higher speed. Accordingly, such image forming apparatus may tend to become relatively greater in size such as in height.

An image forming apparatus using electrophotography may include a fixing unit for fixing un-fixed toner image on sheets.

In case of a high speed printing type, the fixing unit may need to fix toner images on a greater number of sheets per a given unit time. In order to suppress failure of fixing operations, the fixing unit may need a fixing member having a greater heat capacity, which may lead to a size increase of a fixing roller such as a greater radius. Such a size increase of the fixing unit may not be preferable from a viewpoint of manufacturing cost or the like.

Furthermore, such image forming apparatus may need to include a toner bottle having a greater capacity to store toner particles, which may be needed to provide a large capacity for printing operations. For example, a full color image forming apparatus may need three or four color toner bottles, by which a size of the image forming apparatus may become increased such as in height.

Furthermore, an image forming apparatus may include a document scanning unit having an automatic document feeder (ADF), in general, by which a size of the image forming apparatus may become further greater.

However, such image forming apparatus having a relatively greater size or dimension may degrade a user operability of document scanning unit and ADF disposed at a top part of the image forming apparatus or there may be increased difficulty when attaching the document scanning unit or ADF on the image forming apparatus.

In conventional image forming system, a sheet feed apparatus having a large capacity for accommodating sheets may be attached to the image forming apparatus to simply supply greater number of sheets to the image forming apparatus with less consideration on user operability of image forming apparatus or image forming system.

Furthermore, such image forming apparatus (e.g., copying machine) may include a manual feed tray, which may be protruded from the lateral side of the image forming apparatus.

If a sheet feed apparatus having a large capacity for accommodating sheets may be attached to such image forming apparatus side by side, the sheet feed apparatus may need to allocate a given space in its body or the like so that the manual feed tray may not interfere with the body of the sheet feed apparatus. Such space may unfavorably increase a width dimension of the sheet feed apparatus.

Furthermore, such manual feed tray of the image forming apparatus may constrain a height of sheet feed apparatus, which may not be preferable from a viewpoint of storing a large number of sheets.

SUMMARY

An embodiment of the present invention provides a sheet feed apparatus coupled to an image forming apparatus. Such a sheet feeding apparatus can include: a main frame; a storage unit mounted on the main frame and configured with a capacity to store a large quantity of sheet-like material; a transporter mounted on the main frame and configured to supply the sheet-like material to the image forming apparatus; an additional unit adapted to be mounted on the main frame and operable to enhance a functionality of at least one of the sheet feed apparatus and an image forming apparatus; and a supporting frame mounted on the main frame in place of the additional unit, and further adapted such that the additional unit is mountable thereon; the additional unit being mounted on the supporting frame.

Additional features and advantages of the present invention will be more fully apparent from the following detailed description of example embodiments, the accompanying drawings and the associated claims.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
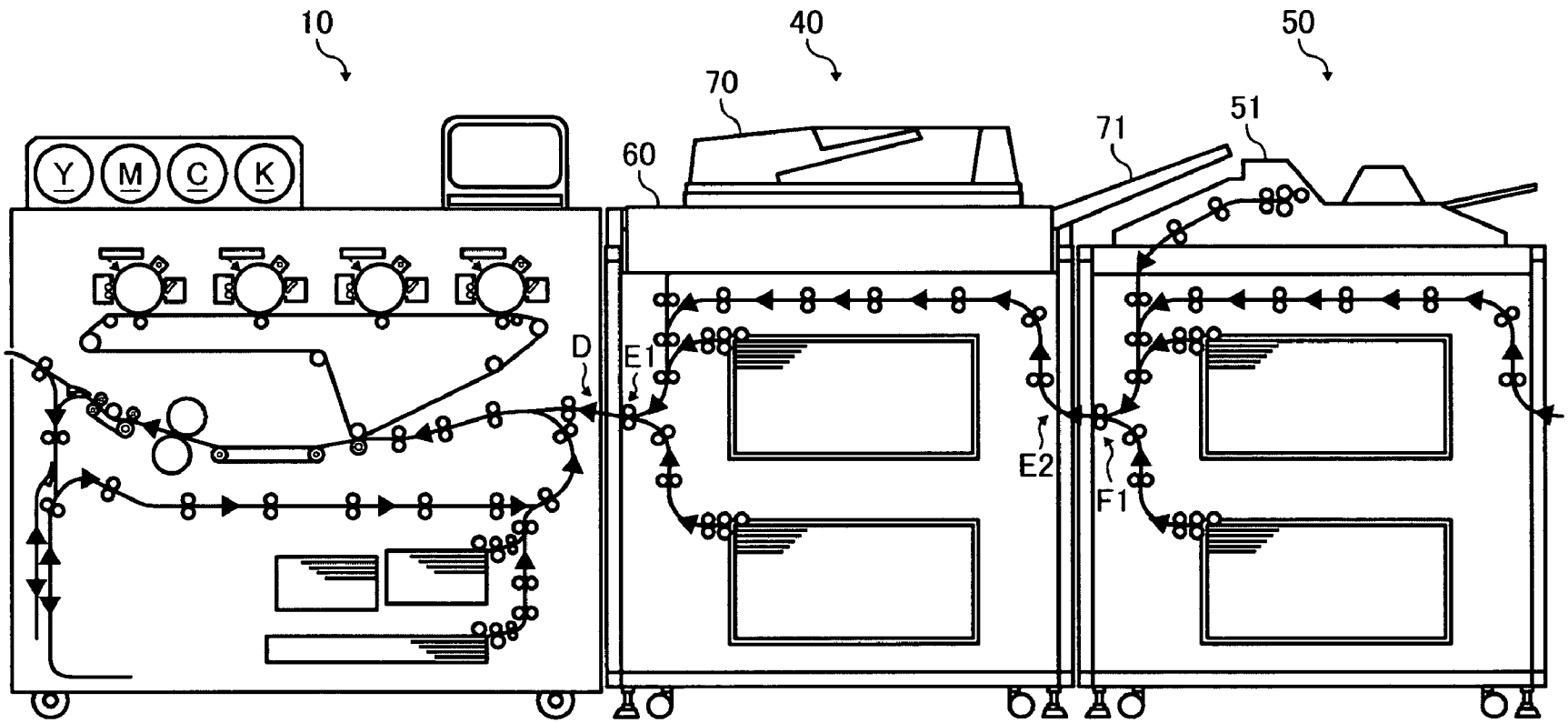
FIG. 1 is a schematic configuration of an image forming system according to an example embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on," "against," "connected to" or "coupled to" another element or layer, then it can be directly on, against connected or coupled to the other element or layer, or intervening elements or layers may be present. In contrast, if an element is referred to as being "directly on", "directly connected to" or "directly coupled to" another element or layer, then there is no intervening elements or layers present.

Like numbers refer to like elements throughout. As used herein, the term "and/or" includes any and all combinations of one or more of the associated listed items.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

Referring now to the drawings, wherein like reference numerals designate identical or corresponding parts throughout the several views, an image forming system according to an example embodiment is described with particular reference to FIG. 1.

As shown in FIG. 1, the image forming system may include an image forming apparatus 10 (e.g., printer), a first sheet feed apparatus 40, and a second sheet feed apparatus 50, for example.

The first and second sheet feed apparatuses 40 and 50 may be a sheet feed apparatus, which may have a capacity to store a large number of sheets. In other words, the first and second sheet feed apparatuses 40 and 50, respectively, may store large numbers of sheets to be supplied to the image forming apparatus 10.

Figure 2:
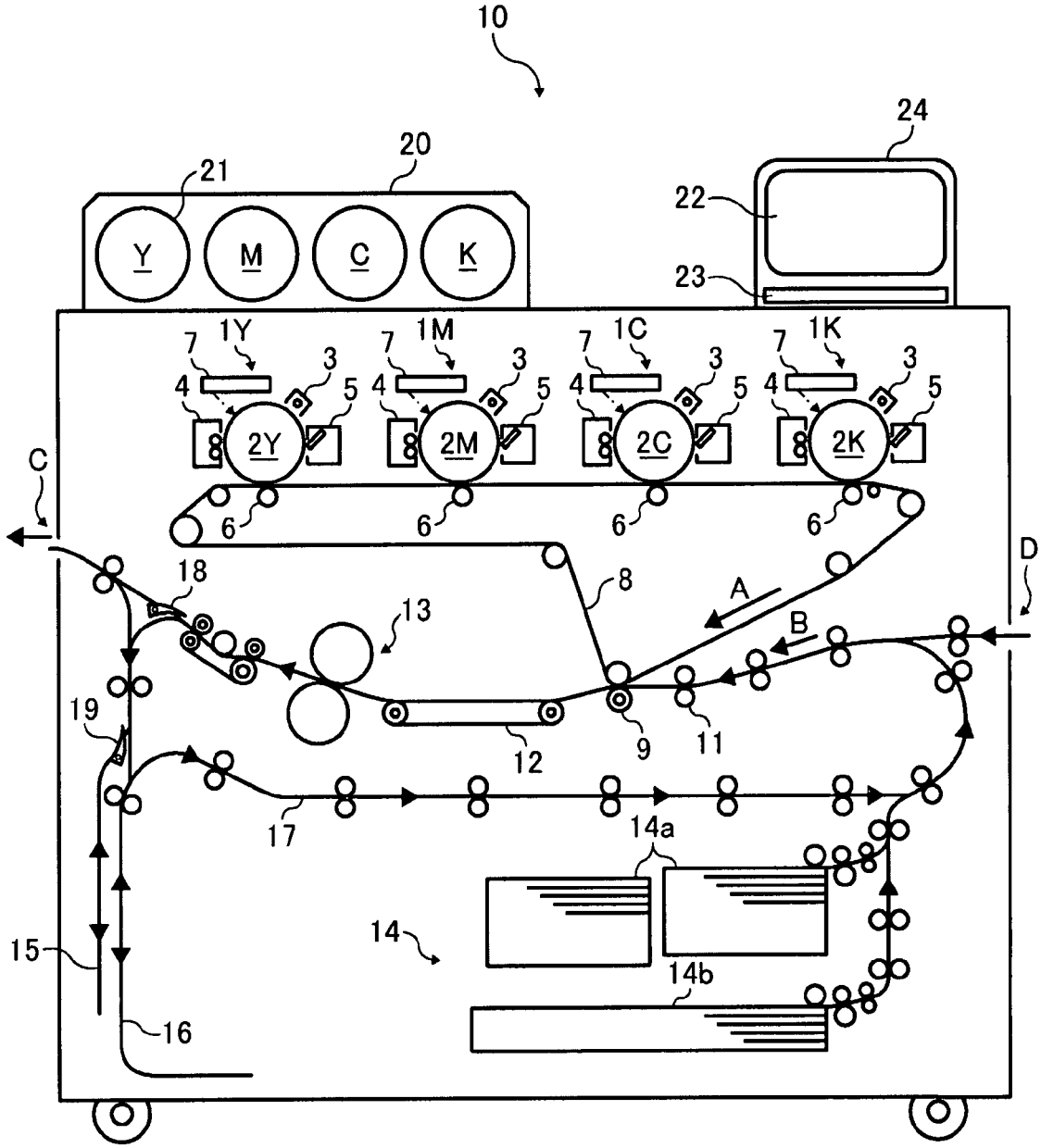
FIG. 2 is a schematic cross-sectional view of an image forming apparatus included in an image forming system of FIG. 1.

As shown in FIGS. 1 and 2, the image forming apparatus 10 may include a full color image forming apparatus, e.g., which may use four color toner of yellow (Y), cyan (C), magenta (M), and black (K) for image forming operation.

As shown in FIG. 2, the image forming apparatus 10 may include image forming units 1Y, 1M, 1C, and 1K, arranged in a tandem manner and provided in an upper portion of the image forming apparatus 10, to form a toner image of each color.

The image forming units 1Y, 1M, 1C, and 1K may have a similar configuration and operating system one another. Accordingly, a term of "image forming unit 1" may be used for image forming units 1Y, 1M, 1C, and 1K as a whole in following explanation, as required.

The image forming unit 1 may include a photoconductor drum 2 as image carrying member, a charger 3, a developing unit 4, a cleaning unit 5, and an optical writing unit 7, for example. The optical writing unit 7 may be disposed over the photoconductor drum 2, for example.

As shown in FIG. 2, an intermediate transfer belt 8 may be extended with a plurality of support rollers under the image forming units 1Y, 1M, 1C, 1K.

The intermediate transfer belt 8 may travel in a direction shown by an arrow A with a rotation of one of the support rollers, driven by a driver (not shown).

As shown in FIG. 2, a transfer roller 6 may be disposed for the photoconductor drum 2 by sandwiching the intermediate transfer belt 8 between the transfer roller 6 and photoconductor drum 2, wherein the transfer roller 6 may be used as primary transfer unit, which may transfer a toner image from the photoconductor drum 2 onto the intermediate transfer belt 8.

In the image forming unit 1, the photoconductor drum 2 may rotate in a counterclockwise direction in FIG. 2, and a surface of the photoconductor drum 2 may be charged to a given polarity and voltage by the charger 3 uniformly.

The optical writing unit 7 may emit a laser beam, modulated based on an original image, to the charged surface of the photoconductor drum 2 to form an electrostatic latent image on the photoconductor drum 2.

The developing unit 4 may develop the electrostatic latent image as toner image on the photoconductor drum 2. A toner image of yellow, cyan, magenta, and black formed by each of the image forming units 1 may be superimposingly transferred to the intermediate transfer belt 8.

The image forming apparatus 10 may further include a sheet feed section 14 having sheet cassettes 14*a* and 14*b*.

The sheet feed section 14 or first and second sheet feed apparatuses 40 and 50 may feed a transfer sheet to the image forming apparatus 10 as recording medium.

The first and second sheet feed apparatuses 40 and 50 may be connected or coupled to the image forming apparatus 10 as shown in FIG. 1.

A transfer sheet, fed from the sheet feed section 14 or first and second sheet feed apparatuses 40 and 50, may be transported to a registration roller 11 in a direction shown by an arrow B in FIG. 2.

The registration roller 11 may temporarily stop the transfer sheet, and then feed the transfer sheet to a secondary transfer nip defined by the intermediate transfer belt 8 and a secondary transfer roller 9 while synchronizing such feed timing with a timing that toner images on the intermediate transfer belt 8 comes to the secondary transfer nip.

The secondary transfer roller 9 may be applied with a voltage having an opposite polarity of toner image. With an effect of secondary transfer roller 9, the superimposed toner image (or full color image) on the intermediate transfer belt 8 may be transferred onto the transfer sheet.

Then, the transfer sheet may be transported to a fixing unit 13 by a transport belt 12, and the fixing unit 13 may fix the toner image on the transfer sheet by applying heat and pressure to the toner image.

After fixing the toner image on the transfer sheet, the transfer sheet may be ejected to an ejection tray (not shown) in a direction shown by an arrow C in FIG. 2.

In case of one-face printing, the transfer sheet may be transported to a sheet-reversing unit 15 and then be ejected to the ejection tray (not shown) in a direction shown by an arrow C in FIG. 2.

In case of double-face printing, the transfer sheet having a fixed image on one face may be transported to the registration roller 11 via a face-reversing unit 16 and re-feed route 17. Then, another toner image may be transferred from the intermediate transfer belt 8 to another face of the transfer sheet. After transferring another toner image, the fixing unit 13 may fix another toner image on the transfer sheet as similar to the one-face printing. After such fixing process, the transfer sheet may be ejected to the ejection tray (not shown) in a direction shown by an arrow C in FIG. 2.

The image forming apparatus 10 may include changeover pawls 18 and 19 to switch a sheet transporting direction, as required.

When the image forming apparatus 10 may conduct a monochrome printing, only the image forming unit 1K for black color may be used to form a toner image, and such toner image may be transferred to the transfer sheet via the intermediate transfer belt 8. After fixing toner image on the transfer sheet, the transfer sheet may be processed as similar to the above-explained case for full color image printing.

As shown in FIG. 1, the image forming apparatus 10 may include a toner bottle compartment 20, which may include a toner bottle 21 for each color. The developing unit 4 may be supplied with fresh toner supplied from the toner bottle 21.

Furthermore, the image forming apparatus 10 may include an operation unit 24 having a display unit 22 and an operation panel 23 on the upper face of the image forming apparatus 10.

Furthermore, the image forming apparatus 10 may include a sheet receiving port unit D on a right side of the image forming apparatus 10 as shown in FIG. 1.

The sheet receiving port unit D may receive a sheet from a sheet feed apparatus such as first sheet feed apparatus 40.

The sheet receiving port unit D may be provided with a port and a transporter to receive and transport a sheet from the first sheet feed apparatus 40 to the image forming apparatus 10.

Figure 3:
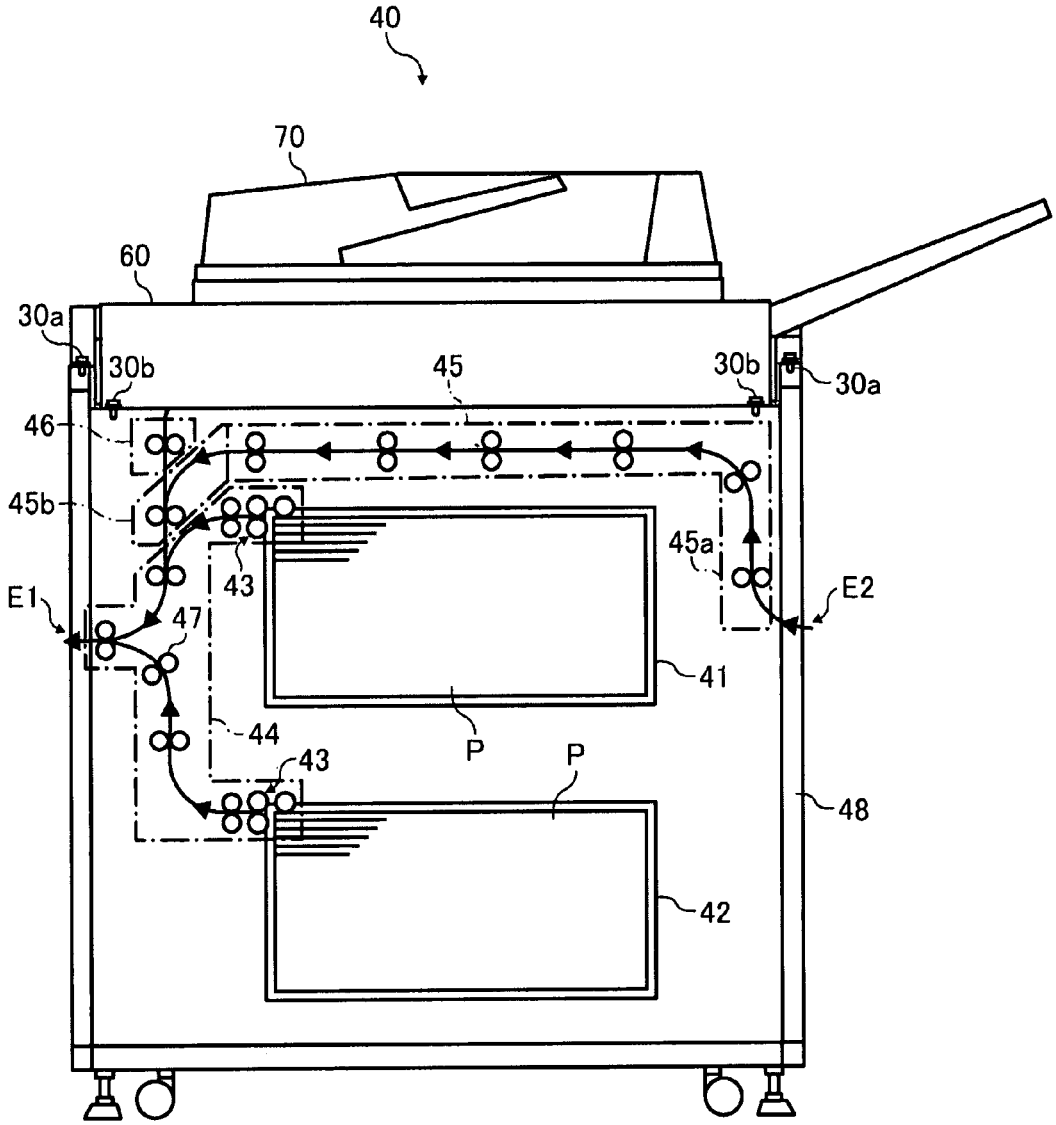
FIG. 3 is a schematic cross-sectional view (according to an example embodiment of the present invention) of a first sheet feed apparatus included in an image forming system of FIG. 1.

Hereinafter, the first sheet feed apparatus 40 having a capacity to accommodate a large number of sheets is explained with reference to FIG. 3. FIG. 3 is a schematic cross-sectional view of the first sheet feed apparatus 40.

As shown in FIG. 3, the first sheet feed apparatus 40 may include sheet cassettes 41 and 42 arranged in a two-stage manner. The sheet cassettes 41 and 42 may store recording medium such as transfer sheet P, for example. Each of the sheet cassettes 41 and 42 may include a feed device 43 to feed a transfer sheet P to a first sheet transport route 44.

The transfer sheet P, fed from the sheet cassette 41 or 42 to the sheet transport route 44, may be transported to a sheet transporting port E1 of the first sheet feed apparatus 40, and then may be fed to the sheet receiving port unit D (refer to FIG. 2) of the image forming apparatus 10.

In addition to the first sheet transport route 44, which may feed the transfer sheet P from the sheet cassettes 41 and 42 to the image forming apparatus 10, the first sheet feed apparatuses 40 may include a second sheet transport route 45 connected or coupled to the second sheet feed apparatus 50, and a third sheet transport route 46 as shown in FIG. 3. The second sheet transport route 45 or third sheet transport route 46 may be connected to the first sheet transport route 44 as shown in FIG. 3.

The second sheet feed apparatus 50 may feed a sheet to the image forming apparatus 10 via the second sheet transport route 45 and first sheet transport route 44.

Each of the sheet transport routes 44, 45, and 46 may be disposed with a given number of transport rollers 47 used as sheet transporter, as required. For the simplicity of the drawing, one transport roller in the sheet transport route 44 may be expressed as the transport roller 47.

Furthermore, in an example embodiment, each of the sheet transport routes 44, 45, and 46 may be configured as one unit.

The second transport route 45 may include a route block 45*a*, withdrawable from the first sheet feed apparatus 40 in one direction. With such withdrawable configuration, a sheet jamming condition in apparatus may be solved more easily.

Furthermore, the second transport route 45 as a whole may be configured as withdrawable unit, for example.

As shown in FIG. 3, the second transport route 45 may have an upstream end portion connected to the sheet receiving port E2.

In the first sheet feed apparatus 40, a transfer sheet or the like may be transported from the upstream side to the downstream side of the second transport route 45, for example.

As shown FIGS. 1 and 3, the sheet transporting port E1 and sheet receiving port E2 may be disposed at a substantially same height each other, and the sheet receiving port unit D of the image forming apparatus 10 may also be disposed at a substantially same height with the sheet transporting port E1 and sheet receiving port E2.

As shown in FIG. 3, an image scanner 60 may be disposed on the first sheet feed apparatus 40, and an automatic document feeder (ADF) 70 may be further disposed on the image scanner 60.

Document image data scanned by the image scanner 60 may be transmitted from the first sheet feed apparatus 40 to the image forming apparatus 10, coupled each other by electrical connector (not shown).

The image scanner 60 and ADF 70 may have a configuration and operation process, which may be publicly known. Accordingly, the image scanner 60 and ADF 70 may be configured with a conventional image scanner and automatic document feeder, by which a manufacturing cost of an image forming system may be suppressed.

Figure 4:
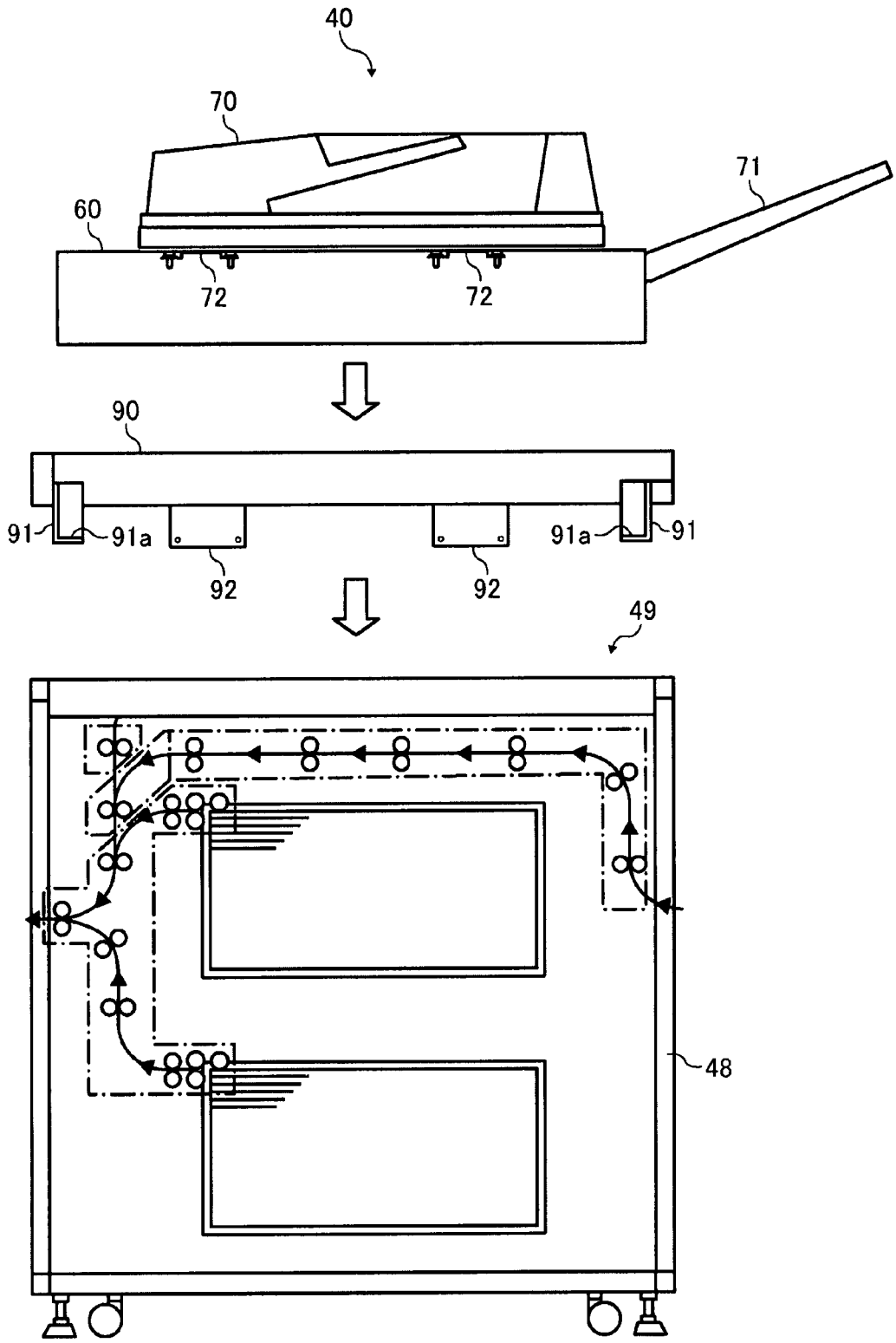
FIG. 4 is an exploded view of a first sheet feed apparatus of FIG. 3.
Figure 5:
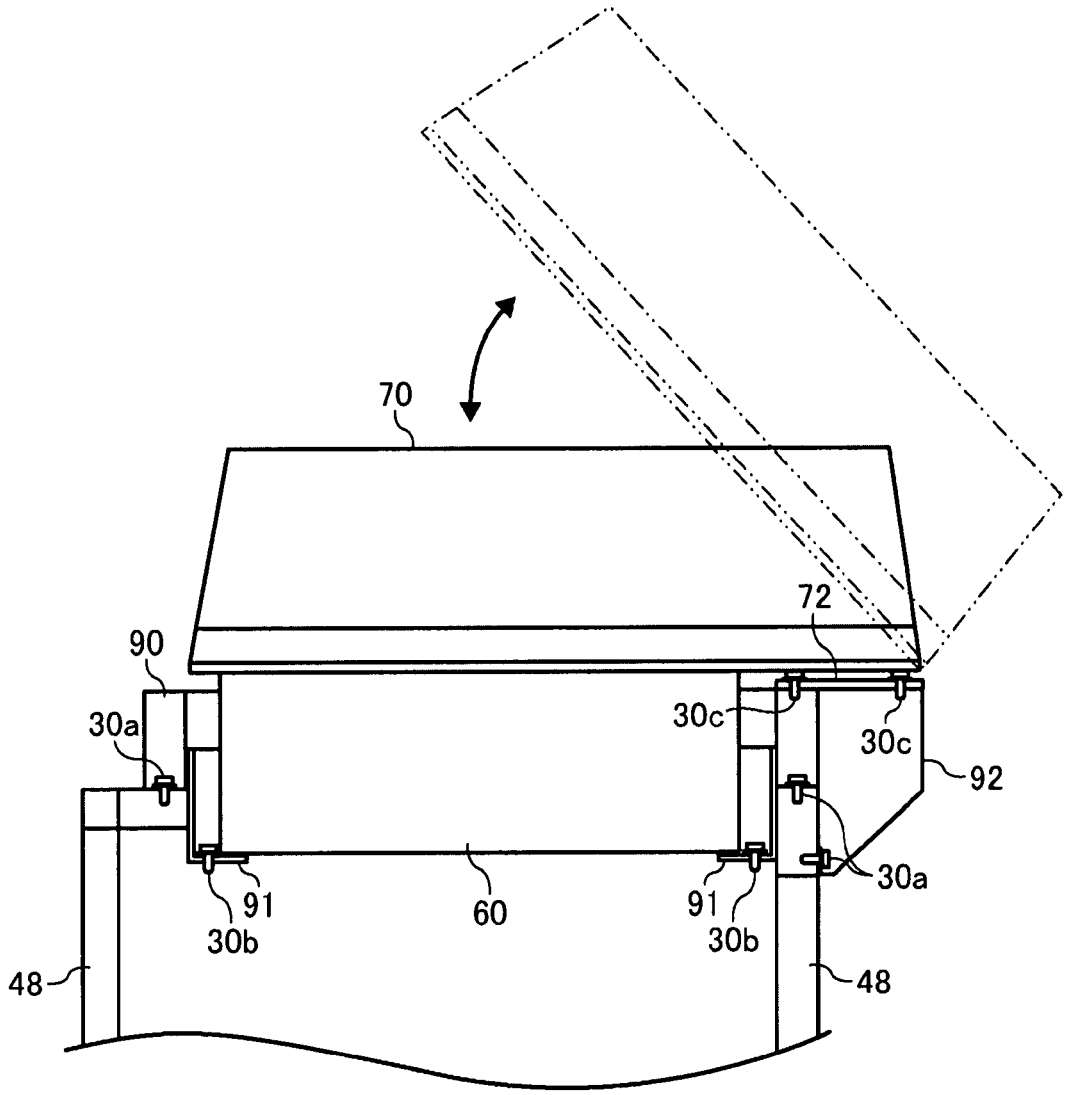
FIG. 5 is a partial side view of a first sheet feed apparatus of FIG. 3.
Figure 6:
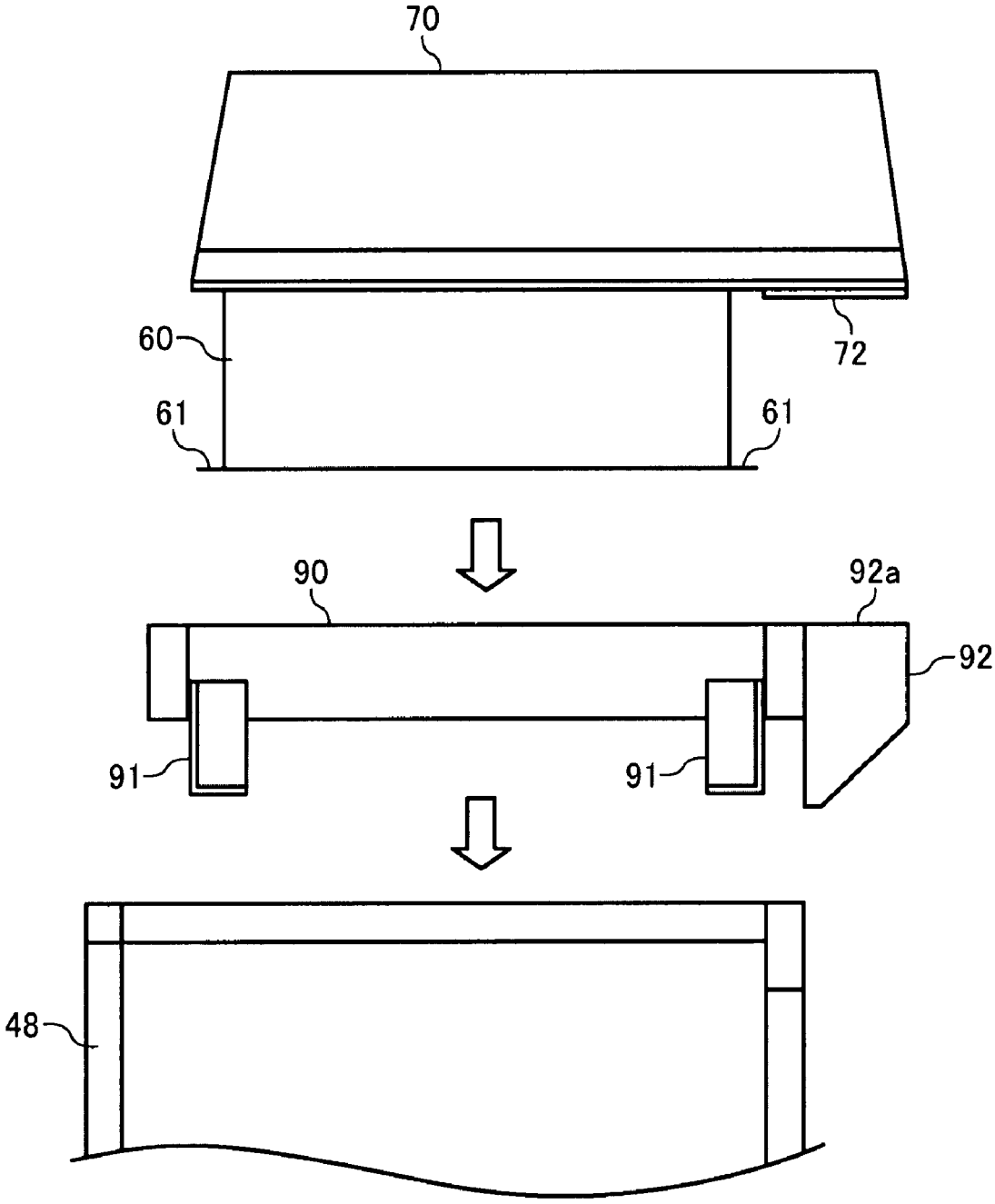
FIG. 6 is a partial exploded view of a first sheet feed apparatus shown in FIG. 5.

FIG. 4 is an exploded view of the first sheet feed apparatus 40, FIG. 5 is a schematic side view of the first sheet feed apparatus 40, and FIG. 6 is another exploded view the first sheet feed apparatus 40 shown in FIG. 5.

As shown in FIGS. 4, 5, and 6, the first sheet feed apparatus 40 may include a body unit 49 (itself including a main frame 48), on which the image scanner 60 and ADF 70 may be attached via a supporting frame (or spacer frame) 90, and inside of which a storage unit and/or a transporter unit may be disposed.

The supporting frame 90 may include a holding member 91 having a bottom plate 91*a*, which may support the image scanner 60 when the image scanner 60 is disposed on the first sheet feed apparatus 40.

As shown in FIG. 6, the holding member 91 having the bottom plate 91*a* may be placed inside of a main frame 48 of the first sheet feed apparatus 40.

Furthermore, the supporting frame 90 may include a hinge member 92 to attach a hinge 72 used for opening and closing the ADF 70 with respect to the image scanner 60.

The supporting frame 90 may include the hinge member 92 at a position corresponding to a rear side of the first sheet feed apparatus 40, for example.

As shown in FIG. 6, the hinge member 92 may have a hinge attachment face 92*a*, to which the hinge 72 may be attached.

The supporting frame 90 may be placed into the main body 49 by fitting the holding member 91 into the main frame 48 of the first sheet feed apparatus 40. The supporting frame 90 may be fixed to the main frame 48 with a fixing screw 30*a* as shown in FIGS. 3 and 5.

The image scanner 60 may be placed on the holding member 91 of the supporting frame 90 as shown in FIG. 5. The image scanner 60 may be fixed to the holding member 91 by fixing a fixing plate 61 (refer to FIG. 6) to the holding member 91 with a fixing screw 30*b*. With such screw-fixing process, the image scanner 60 may be fixed to the main frame 48 of the first sheet feed apparatus 40 via the supporting frame 90.

Furthermore, the hinge 72 of the ADF 70 may be fixed to the hinge attachment face 92*a* of the hinge member 92 with a fixing screw 30*c*. With such screw-fixing process, the ADF 70 may be fixed to the main frame 48 of the first sheet feed apparatus 40 via the supporting frame 90, and may be supported in an openable/closable condition with respect to the image scanner 60.

With such configuration, a stress force, which may occur when opening and closing the ADF 70, may be dispersed to the main frame 48 for a given level, by which the hinge member 92 may have a relatively higher reliability over the time.

Hereinafter, the second sheet feed apparatus 50 also used as a sheet feed apparatus having a capacity to accommodate a large number of sheets is explained with reference to FIG. 7.

Figure 7:
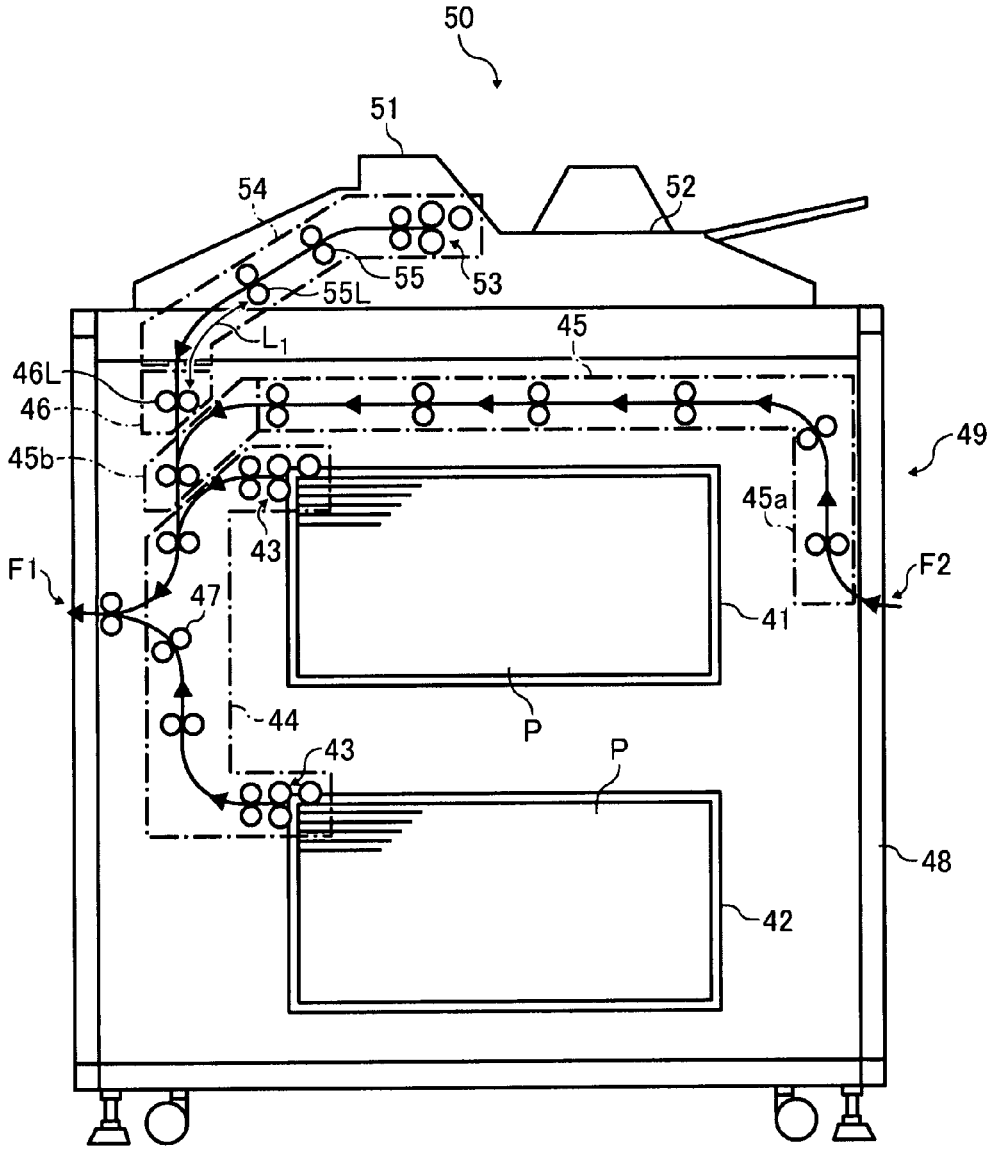
FIG. 7 is a schematic cross-sectional view (according to an example embodiment of the present invention) of a second sheet feed apparatus included in an image forming system of FIG. 1.

As shown in FIG. 7, the second sheet feed apparatus 50 may include a manual sheet feed unit 51 attached on the body unit 49. The body unit 49 used for the second sheet feed apparatus 50 may have a similar configuration of the body unit 49 (including the main frame 48) used for the first sheet feed apparatus 40. Accordingly, reference characters used for the first sheet feed apparatus 40 may be similarly used for the second sheet feed apparatus 50 in the following explanation.

Furthermore, the manual sheet feed unit 51 may include a conventional manual sheet feed unit, for example, by which a manufacturing cost of an image forming system may be suppressed.

As shown in FIG. 7, the second sheet feed apparatus 50 may include a sheet transporting port F1, which may be provided at a downstream end portion of the first sheet transport route 44.

The second sheet feed apparatus 50 may also include a sheet receiving port F2 at an upstream end portion of the second sheet transport route 45.

In the second sheet feed apparatus 50, a transfer sheet or the like may be transported from the upstream side to the downstream side of the second transport route 45, for example.

As shown FIG. 7, the sheet transporting port F1 and sheet receiving port F2 may be disposed at a substantially same height each other, for example. Furthermore, the sheet transporting port F1 and sheet receiving port F2 may be disposed at a substantially same height of the sheet receiving port unit D of the image forming apparatus 10, and the sheet transporting port E1 and sheet receiving port E2 of the first sheet feed apparatus 40, for example.

As shown in FIG. 7, the manual sheet feed unit 51 may include a sheet tray 52 and a sheet feeder 53, for example.

The sheet tray 52 may be used to place recording medium such as transfer sheet or the like, and the sheet feeder 53 may be used to transport the recording medium to the body unit 49.

A transfer sheet placed on the sheet tray 52 may be transported in a sheet transport route 54 with an effect of a transport roller 55, and then be transported to the third sheet transport route 46 in the body unit 49. A given number of the transport rollers 55 may be disposed in the sheet transport route 54, as required.

The transfer sheet may further be transported to the transport route 45*b* of the second transport route 45 and to the first sheet transport route 44, and then to the sheet transporting port F1.

From the sheet transporting port F1, the transfer sheet may be transported to the sheet receiving port E2 (refer to FIG. 3) of the sheet feed apparatus 40.

Furthermore, the second sheet feed apparatus 50 may include the sheet cassettes 41 and 42, which may store the transfer sheet P.

The transfer sheet P, fed from the sheet cassette 41 or 42 to the sheet transport route 44, may be transported to the sheet transporting port F1, and then may be fed to the sheet receiving port E2 (refer to FIG. 3) of the first sheet feed apparatus 40.

The transfer sheet P, fed from the second sheet feed apparatus 50 to the first sheet feed apparatus 40, may be transported to the sheet transporting port E1 of the first sheet feed apparatus 40 via the second sheet transport route 45 and first sheet transport route 44 in the first sheet feed apparatus 40.

From the sheet transporting port E1, the transfer sheet P may be fed to the sheet receiving port unit D of the image forming apparatus 10.

As similar to the first sheet feed apparatus 40, the second sheet feed apparatus 50 may also include the second sheet transport route 45.

With such second sheet transport route 45, which can be used as interlinking route for coupling a plurality of transport routes among different sheet feed apparatuses, another sheet feed apparatus (not shown) similar to the first sheet feed apparatus 40 or second sheet feed apparatus 50 may be connected or coupled to the second sheet feed apparatus 50 at the sheet receiving port F2 shown in FIG. 7.

In case of connecting or coupling another sheet feed apparatus (not shown) to the second sheet feed apparatus 50, a transfer sheet in another sheet feed apparatus may be fed to the second sheet feed apparatus 50 from another sheet feed apparatus (not shown) via the sheet receiving port F2 of the second sheet feed apparatus 50.

Furthermore, because each of the first and second sheet feed apparatuses 40 and 50 may have a common unit or part such as body unit 49, the first and second sheet feed apparatuses 40 and 50 may be interchangeably arranged with respect to the image forming apparatus 10.

For example, although not shown, the second sheet feed apparatus 50 may be connected next to the image forming apparatus 10, and the first sheet feed apparatus 40 may be connected next to the second sheet feed apparatus 50.

As above-explained, in an image forming system according to an example embodiment, the image forming apparatus 10 may be connected or coupled to a plurality of sheet feed apparatuses having a large capacity to transfer sheets (e.g., first sheet feed apparatus 40, second sheet feed apparatus 50).

Accordingly, a larger number of sheets may be supplied to the image forming apparatus 10 with an uninterrupted manner during an image forming operation, by which the image forming apparatus 10 can conduct an image forming operation such as copying/printing operation upon a larger number of sheets with a relatively higher speed manner.

In general, an image forming apparatus, which can copy/print a greater number of sheets with a relatively higher speed manner, may include a fixing unit having a fixing roller or pressure roller having a greater diameter, and a toner bottle having a greater size and thus capacity to store a greater quantity of toner(s), by which such image forming apparatus may have a relatively greater dimension (e.g., relatively higher height). If an image scanner or automatic document feeder may be further disposed on such image forming apparatus, a total dimension (e.g., total height) of image forming apparatus may become unfavorably greater and such image forming apparatus may decrease an user operability of apparatus as a whole.

In an example embodiment, the image scanner 60 and ADF 70 may be disposed on the first sheet feed apparatus 40. The image scanner 60 and ADF 70 may be used for automatically scanning a greater volume of documents at relatively higher speed when conducting a copying operation, for example. Furthermore, the manual sheet feed unit 51 may be disposed on the second sheet feed apparatus 50, by which a variety types of sheets can be supplied as recording medium such as relatively thicker or thinner sheet, for example.

With such configuration, a total height of the image forming apparatus 10 may be suppressed to a given level, which may not degrade a user operability of operation panel 23 (refer to FIG. 2) disposed on a top face of the image forming apparatus 10.

Furthermore, such configuration for the image forming apparatus 10 may improve an efficiency of replacement work of toner bottles to the toner bottle compartment 20.

Accordingly, an image forming system according to an example embodiment may realize a relatively higher functionality of image forming operation and a better user operability of the image forming apparatus and image forming system.

Furthermore, in an example embodiment, the image forming apparatus 10, the image scanner 60 and ADF 70 placed on the first sheet feed apparatus 40, and the manual sheet feed unit 51 placed on the second sheet feed apparatus 50 may have a substantially similar height each other as shown in FIG. 1.

Accordingly, a user can set or remove documents to the image scanner 60 and ADF 70 or manual sheet feed unit 51 easily with a similar level of user operability of the image forming apparatus 10.

Accordingly, an image forming system according to an example embodiment may realize a wider range of operation such as relatively higher speed image forming operation for a large number of sheets and manual feeding function, and better user operability for image forming apparatus and image forming system.

As explained with FIG. 4, the first sheet feed apparatus 40 may include the image scanner 60 and ADF 70 attached on the body unit 49 via the supporting frame 90.

The second sheet feed apparatus 50 may include the manual sheet feed unit 51 attached on the body unit 49 directly, in which the supporting frame 90 may not be used.

With such configuration, a height level of an ejection tray 71 of ADF 70 and a height level of the manual sheet feed unit 51 may be set to different levels in a vertical direction.

For example, when the first and second sheet feed apparatuses 40 and 50 are arranged side by side as shown in FIG. 1, the ejection tray 71, protruding from the first sheet feed apparatus 40 in a rightward direction, and the manual sheet feed unit 51 may not interfere each other. The first and second sheet feed apparatuses 40 and 50 may both include the main frame 48.

Figure 8:
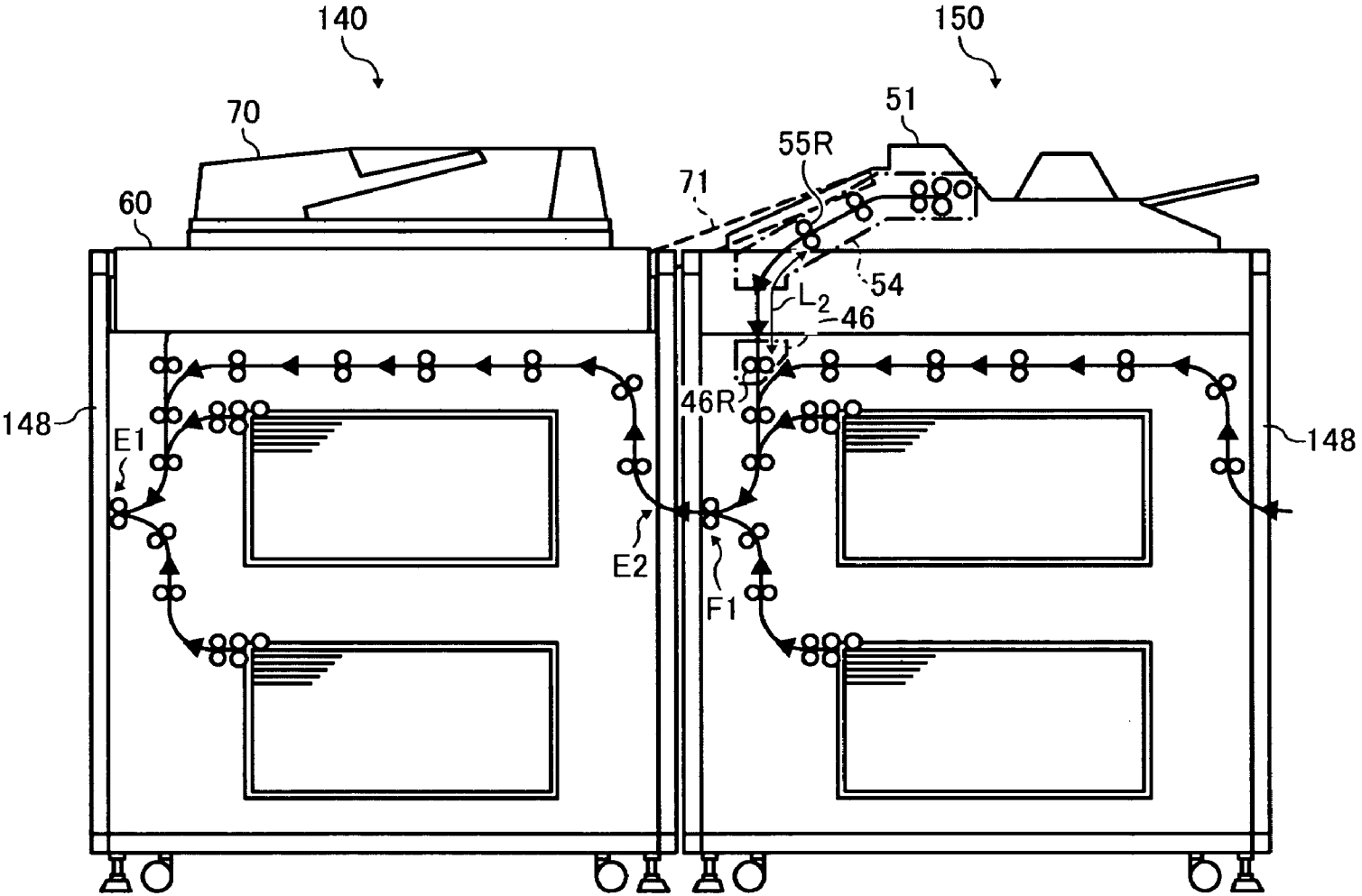
FIG. 8 is a schematic view for an example arrangement of apparatuses interfering with each other.

FIG. 8 shows an configuration of another arrangement of sheet feed apparatuses, in which a first sheet feed apparatus 140 may include the image scanner 60 and ADF 70 attached on the main frame 148 directly without using the supporting frame 90, and a second sheet feed apparatus 150 may include the manual sheet feed unit 51 attached on the main frame 148 directly without using the supporting frame 90.

In such configuration shown in FIG. 8, the ejection tray 71 and the manual sheet feed unit 51 may interfere each other because a height level of the manual sheet feed unit 51 on the second sheet feed apparatus 150 and a height level of the ejection tray 71 of the first sheet feed apparatus 140 may become a substantially similar level. As a result, it can be difficult to dispose the first and second sheet feed apparatuses 140 and 150 into a close side by side arrangement.

A closer side-by-side arrangement of the first and second sheet feed apparatuses 140 and 150 may be realized if main frames having different height may be used for each of the first and second sheet feed apparatuses 140 and 150, for example.

However, such method may increase types of parts for manufacturing a sheet feed apparatus, which may not be preferable from a viewpoint of reducing or suppressing a manufacturing cost of apparatus. In general, using common parts as much as possible may reduce a manufacturing cost of apparatus.

Furthermore, in a configuration shown in FIG. 8, a height level of the manual sheet feed unit 51 in the second sheet feed apparatus 150 may become relatively higher.

In such configuration shown in FIG. 8, a distance L2 between a transport roller 55R in the sheet transport route 54 and a transport roller 46R in the third transport route 46 may become longer. The transport roller 55R may be a provided at an exit portion of the sheet transport route 54.

If the distance L2 may become too long, a smaller sized sheet may not be effectively transported from the manual sheet feed unit 51 to the main frame 148.

Furthermore, if the height level of the manual sheet feed unit 51 in the second sheet feed apparatus 150 may be set to a higher level, a size of main frame or outer cover may also be set to a greater size, by which a manufacturing cost of apparatus may increase unfavorably.

In an example embodiment, the first sheet feed apparatus 40 may include the image scanner 60 and ADF 70 attached to the body unit 49 via the supporting frame 90 as above explained.

The first and second sheet feed apparatuses 40 and 50 may have substantially same height level for a top face position of body unit 49 for each of the first and second sheet feed apparatuses 40 and 50 when the first and second sheet feed apparatuses 40 and 50 are arranged side by side at close proximity.

However, in a circumstance in which the first sheet feed apparatus 40 includes the supporting frame (spacer frame) 90 as above explained, the ejection tray 71 on the first sheet feed apparatus 40 is sufficiently elevated relative to the manual sheet feed unit 51 of the second sheet feed apparatus 50 so as not to interfere with each other, which facilitates disposing the first sheet feed apparatus 40 and the second sheet feed apparatus 50 into at close proximity in a side by side arrangement, as shown in FIG. 1.

Accordingly, the first sheet feed apparatus 40 and second sheet feed apparatus 50 may be closely arranged side by side.

Furthermore, because the first and second sheet feed apparatuses 40 and 50 can employ a common type of parts such as body unit 49, a manufacturing cost of sheet feed apparatus may be reduced and a total size of sheet feed apparatus may be reduced.

Furthermore, in an example embodiment, an image forming apparatus may be connected or coupled to a plurality of sheet feed apparatuses having a large capacity for feeding sheets, by which image forming apparatus can be supplied with a large quantity of sheets uninterruptedly from the sheet feed apparatuses.

Furthermore, in an image forming system according to an example embodiment, the image scanner 60 and ADF 70 may be disposed on the first sheet feed apparatus 40, and the manual sheet feed unit 51 may be disposed on the second sheet feed apparatus 50, for example.

The image scanner 60 and ADF 70 and the manual sheet feed unit 51 may be configured in the image forming system to enhance a functionality of image forming system.

If a manual feed tray is disposed at a side portion of the second sheet feed apparatus 50, such manual feed tray may become an obstacle to closely arrange sheet feed apparatuses side by side.

Because the manual sheet feed unit 51 may be disposed on the second sheet feed apparatus 50, such unpreferable interference may not occur between sheet feed apparatuses when arranged side by side.

Furthermore, the ejection tray 71 of the first sheet feed apparatus 40 may not interfere with the manual sheet feed unit 51 on the second sheet feed apparatus 50. In other words, a height level of ejection tray 71 and manual sheet feed unit 51 may be adjusted to any given level, which may not constrain on the height of the first and second sheet feed apparatuses 40 and 50.

Accordingly, the first and second sheet feed apparatuses 40 and 50 may be manufactured with a given size, which may enhance a capacity of sheets to be stored in apparatus.

Furthermore, as above explained, the second sheet feed apparatus 50 may include the manual sheet feed unit 51 attached directly on the body unit 49 without the supporting frame 90.

Accordingly, a distance L1 (see FIG. 7) between a transport roller 55L in the manual sheet feed unit 51 and a transport roller 46L in the third transport route 46 may be set to a shorter distance, by which the manual sheet feed unit 51 can transport and feed a smaller-sized sheet to the body unit 49 effectively.

Figure 9:
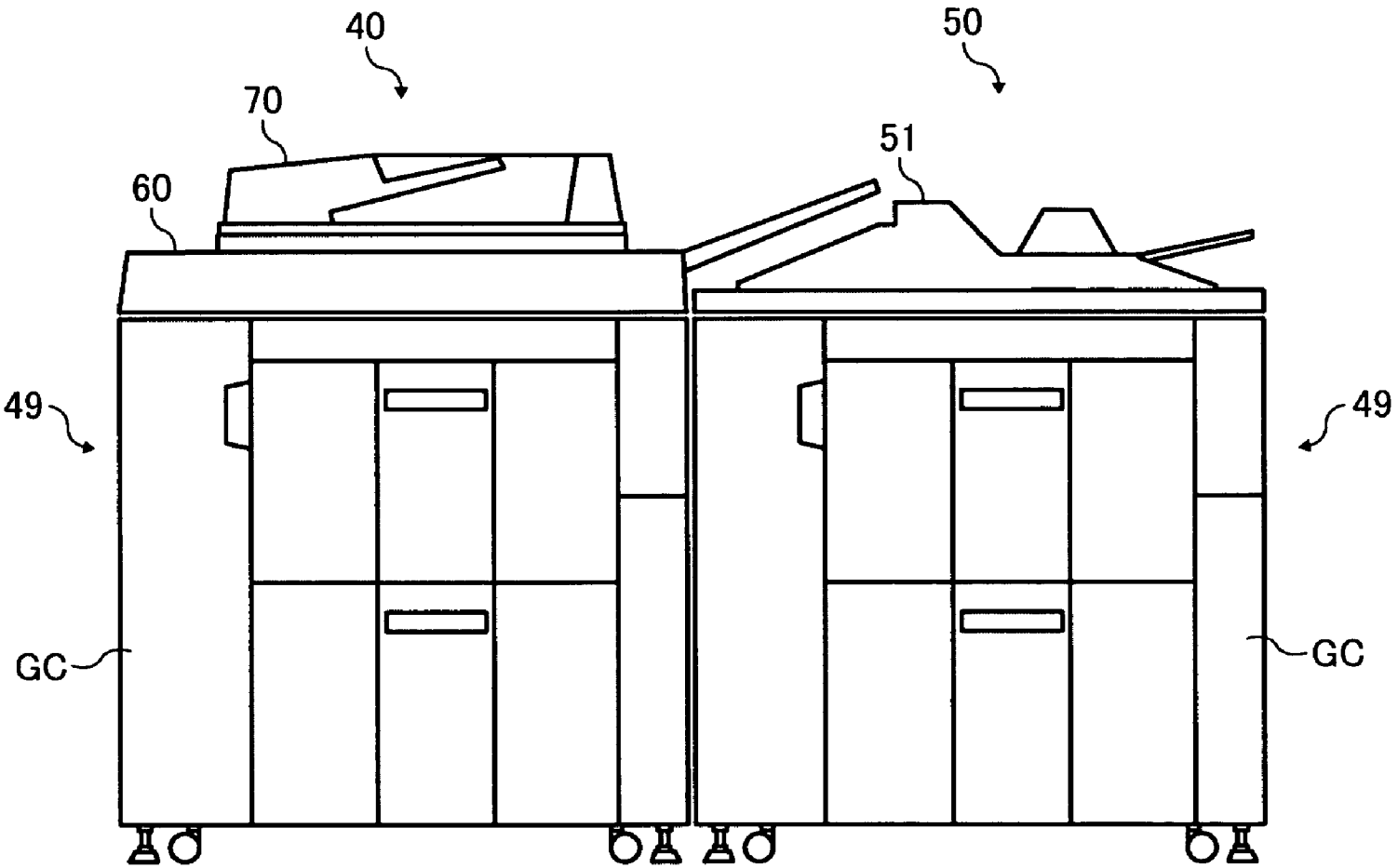
FIG. 9 is a front view (according to an example embodiment of the present invention) of a first sheet feed apparatus and second sheet feed apparatus connected each other.

Furthermore, the first and second sheet feed apparatuses 40 and 50 may employ the body unit 49, and an outer cover GC, which is another common part as shown in FIG. 9. With such common part employment, a sheet feed apparatus may be manufactured with a relatively lower cost.

Furthermore, the image scanner 60 and ADF 70 and manual sheet feed unit 51 may employ a conventional image scanner, ADF, and manual sheet feed unit, by which a sheet feed apparatus may be manufactured with a relatively lower cost.

Hereinafter, another example of the first and second sheet feed apparatuses 40 and 50 may be explained with reference to FIGS. 10 and 11.

Although a sheet feed apparatus (e.g., first sheet feed apparatus 40) may have the second sheet transport route 45 used for interlinking transport routes among a plurality of sheet feed apparatuses, such second sheet transport route 45 may be removed from the sheet feed apparatus in some cases.

In one case, if the image forming apparatus 10 is connected to only one sheet feed apparatus 40, such second sheet transport route 45 may not be required.

In another case, if a plurality of sheet feed apparatuses 40 are connected or coupled to the image forming apparatus 10, a sheet feed apparatus, which is farthest from the image forming apparatus 10 may not need the transport route 45*a*.

Figure 10:
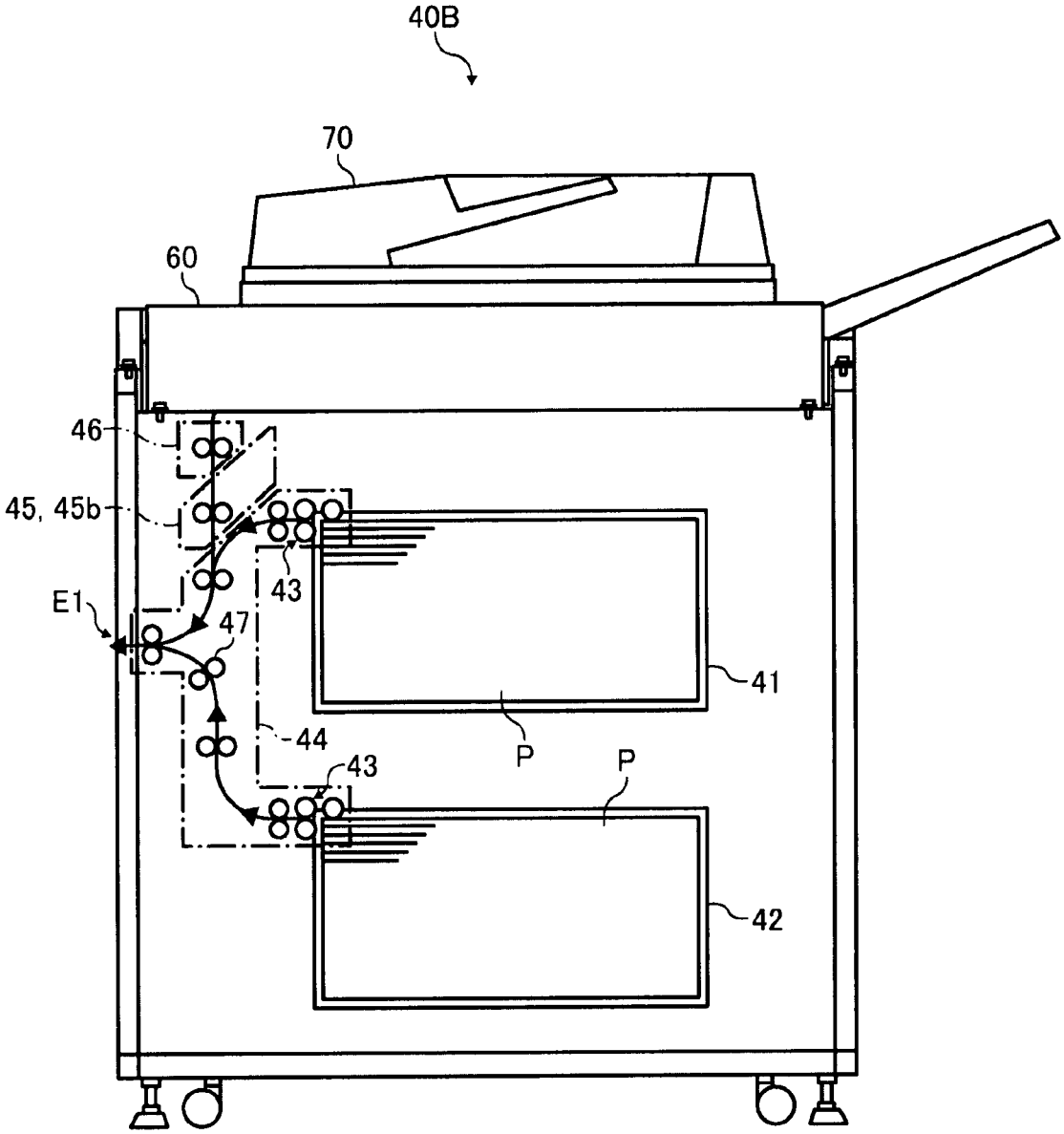
FIG. 10 is a schematic cross-sectional view (according to an example embodiment of the present invention) of another first sheet feed apparatus.

FIG. 10 shows a first sheet feed apparatus 40B having no transport route 45*a*, which is a part of the second transport route 45 shown in FIG. 3.

Except for removing the transport route 45*a*, the first sheet feed apparatus 40B may have a similar configuration of the first sheet feed apparatus 40 shown in FIG. 3.

Because the transport route 45*a* may be configured to be withdrawable from the first sheet feed apparatus 40 as above-mentioned, a configuration having no transport route 45*a* can be realized easily.

Because the transport route 45*a* may not be included in the first sheet feed apparatus 40B as such, the first sheet feed apparatus 40B may have a simpler configuration, by which a sheet feed apparatus may be manufactured with a relatively lower cost.

Such first sheet feed apparatus 40B may have functionality similar to the first sheet feed apparatus 40 shown in FIG. 3.

Furthermore, the third sheet transport route 46 can be further removed from the first sheet feed apparatus 40 because the image scanner 60 and ADF 70 may have no function to transport a recording medium such as sheet to other apparatus. Accordingly, a further reduction of number of parts can be realized for the first sheet feed apparatus 40B.

Similarly, the transport route 45*a* can be removed from the second sheet feed apparatus 50, in which the second sheet feed apparatus 50 may have a simpler configuration, by which a sheet feed apparatus may be manufactured with a relatively lower cost.

In one case, if the image forming apparatus 10 is connected to only one sheet feed apparatus 50, such second sheet transport route 45 may not be required.

In another case, if a plurality of sheet feed apparatuses 50 are connected or coupled to the image forming apparatus 10, a sheet feed apparatus, which is farthest from the image forming apparatus 10 may not need the transport route 45*a*.

Figure 11:
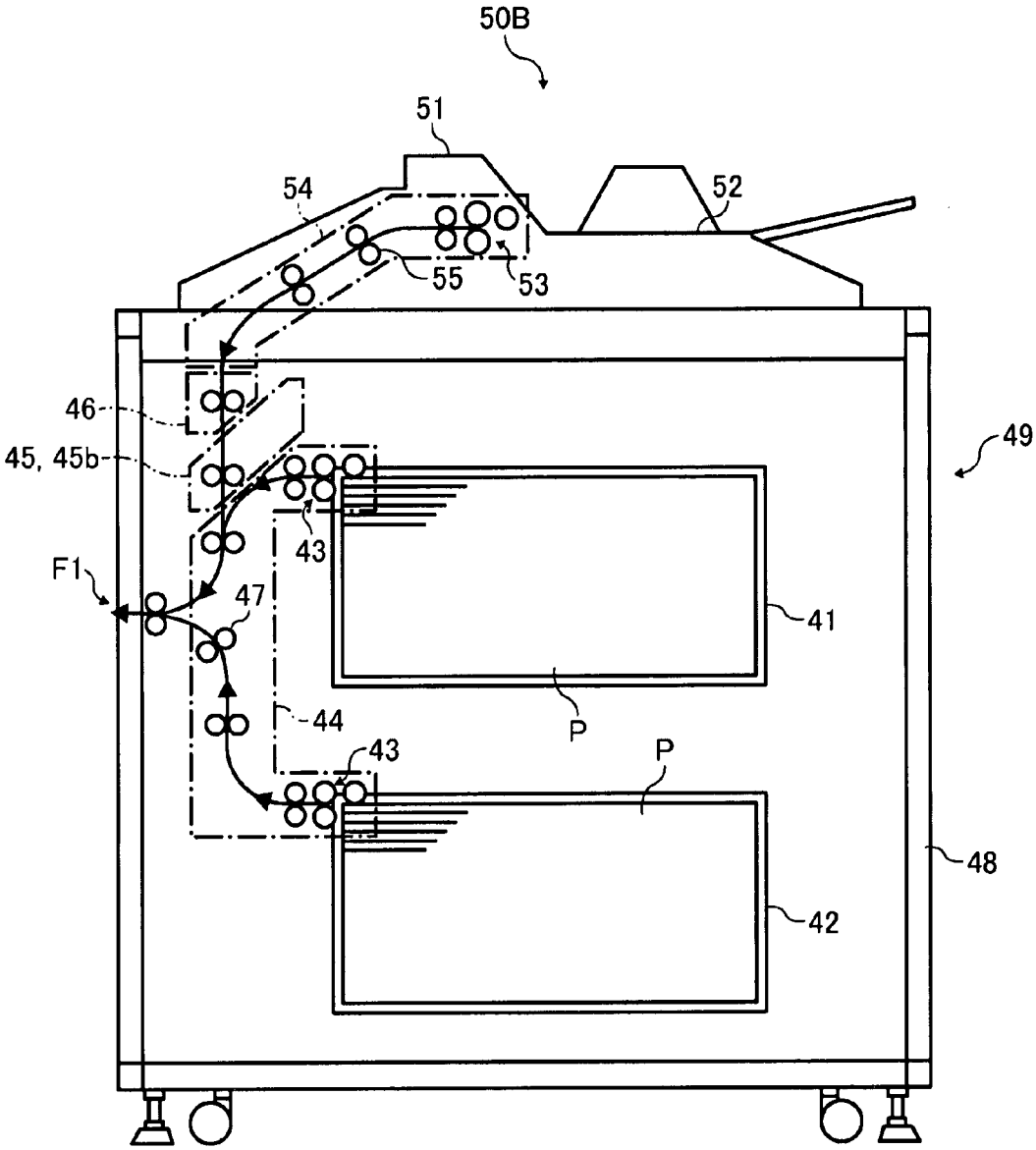
FIG. 11 is a schematic cross-sectional view (according to an example embodiment of the present invention) of another second sheet feed apparatus.

FIG. 11 shows a second sheet feed apparatus 50B having no transport route 45*a*, which is a part of the second transport route 45 shown in FIG. 3.

Except for removing the transport route 45*a*, the second sheet feed apparatus 50B may have a similar configuration of the second sheet feed apparatus 50 shown in FIG. 7

Because the transport route 45*a* may be configured to be withdrawable from the second sheet feed apparatus 50 as above-mentioned, a configuration having no transport route 45*a* can be realized easily.

Because the transport route 45*a* may not be included in the second sheet feed apparatus 50B as such, the second sheet feed apparatus 50B may have a simpler configuration, by which a sheet feed apparatus may be manufactured with a relatively lower cost.

Such second sheet feed apparatus 50B may have functionality similar to the second sheet feed apparatus 50 shown in FIG. 7.

Hereinafter, another example of the first and second sheet feed apparatuses 40 and 50 is explained with reference to FIGS. 12 and 13.

Figure 12:
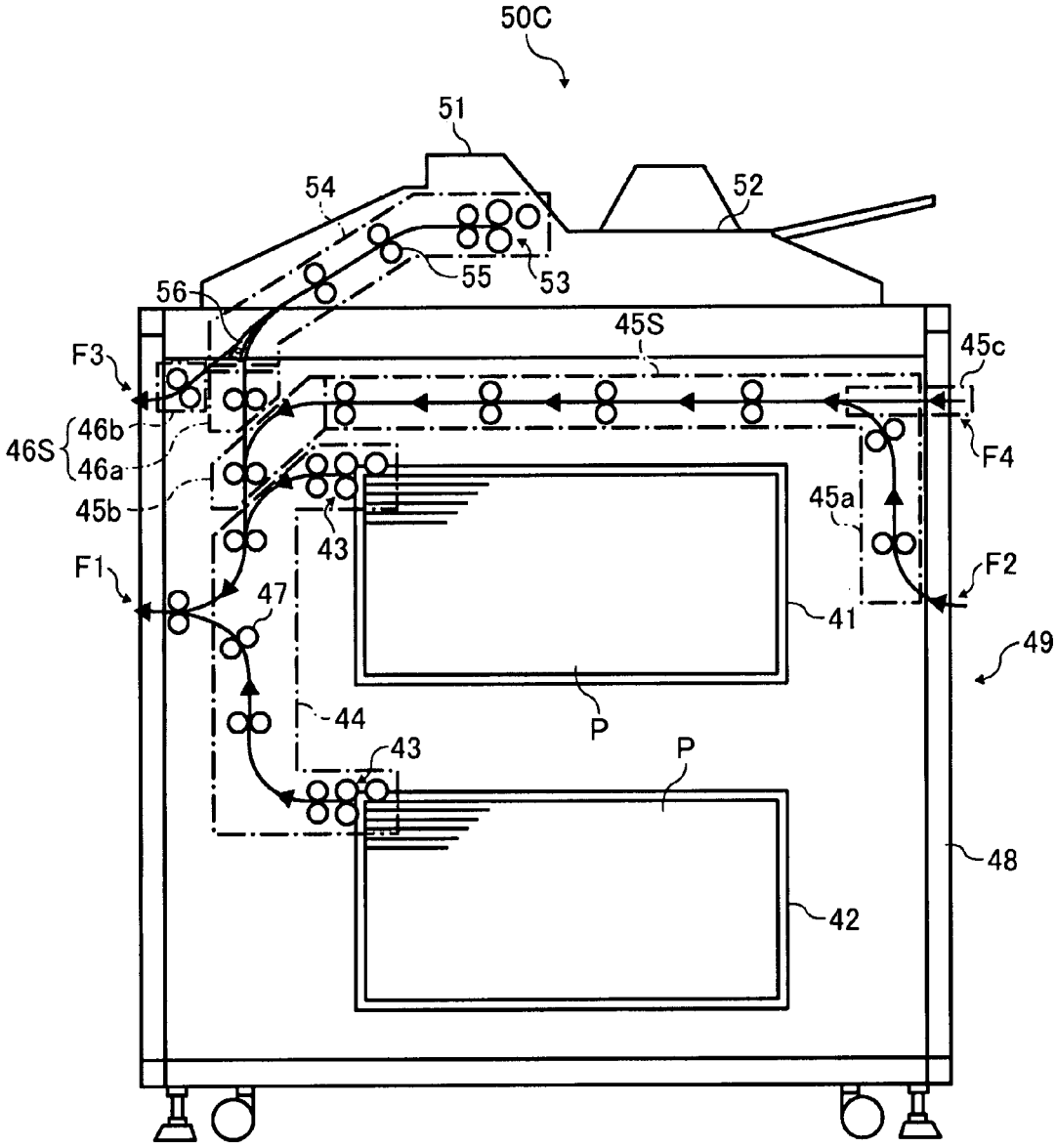
FIG. 12 is a schematic cross-sectional view (according to an example embodiment of the present invention) of another second sheet feed apparatus.

FIG. 12 shows a second sheet feed apparatus 50C, which is another example of the second sheet feed apparatus 50.

As shown in FIG. 12, the second sheet feed apparatus 50C may have a second transport route 45S having transport routes 45*a*, 45*b*, and 45*c*. The transport route 45*c* having a straight-line configuration is added to the second transport route 45 shown in FIG. 3.

Furthermore, the second sheet feed apparatus 50C may have a third sheet transport route 46S having transport routes 46*a* and 46*b*. The transport route 46*a* may be extended in a vertical direction and the transport route 46*b* may be extended in a slanted direction as shown in FIG. 12.

The second sheet feed apparatus 50C may have a configuration similar to the second sheet feed apparatus 50 shown in FIG. 7 for other parts.

As shown in FIG. 12, the transport route 45*c* may include a sheet receiving port F4 and the transport route 46*b* may include a sheet transporting port F3, in which the sheet receiving port F4 and sheet transporting port F3 may have a substantially same height level.

Furthermore, a changeover pawl 56 may be disposed near the transport route 46*a* and 46*b*. The changeover pawl 56 may switch a transport direction of sheet, fed from the manual sheet feed unit 51, to one of the transport route 46*a* and 46*b*. The changeover 56 may be driven by a solenoid (not shown) to switch a transport direction of sheet fed from the manual sheet feed unit 51.

Figure 13:
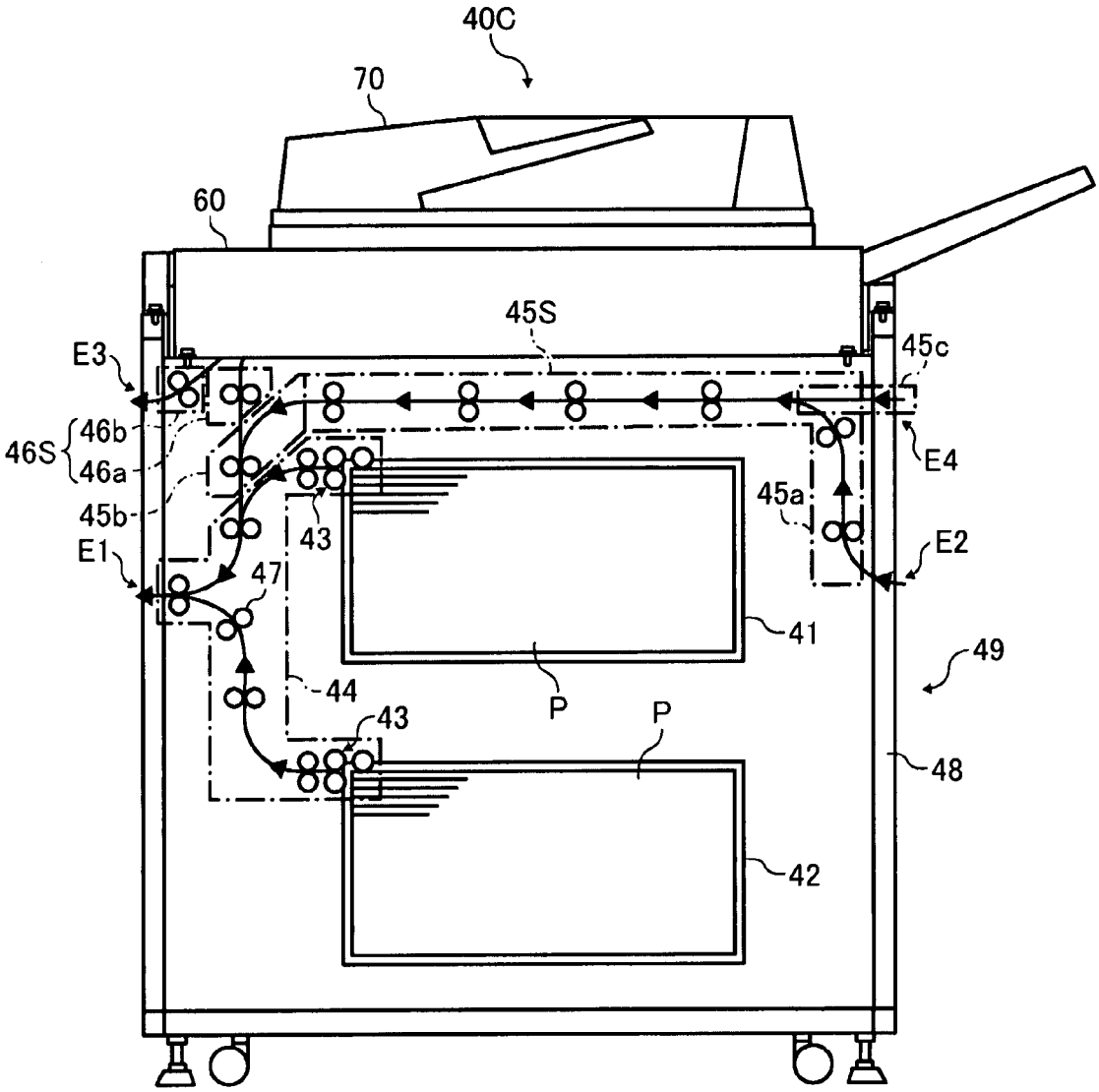
FIG. 13 is a schematic cross-sectional view (according to an example embodiment of the present invention) of another first sheet feed apparatus.

FIG. 13 shows a first sheet feed apparatus 40C, which is another example of the first sheet feed apparatus 40.

As shown in FIG. 13, the first sheet feed apparatus 40C may have the second transport route 45S having transport routes 45*a*, 45*b*, and 45*c* as similar to the second sheet feed apparatus 50C shown in FIG. 12.

Furthermore, the first sheet feed apparatus 40C may have the third sheet transport route 46S having transport routes 46*a* and 46*b* as similar to the second sheet feed apparatus 50C shown in FIG. 12.

The first sheet feed apparatus 40C may have a configuration similar to the first sheet feed apparatus 40 shown in FIG. 3 for other parts.

As shown in FIG. 13, the transport route 45*c* may include a sheet receiving port E4 and the transport route 46*b* may include a sheet transporting port E3, in which the sheet receiving port E4 and sheet transporting port E3 may have a substantially same height level.

In the first sheet feed apparatus 40C, the image scanner 60 and ADF 70 may not transport and feed recording medium such as sheet to the body unit 49.

Accordingly, the transport route 46*b* and sheet transporting port E3 may not be in need for the first sheet feed apparatus 40C.

However, the transport route 46*b* and sheet transporting port E3 may be remained in the body unit 49 so that the first sheet feed apparatus 40C can employ common parts with the second sheet feed apparatus 50C.

The changeover pawl 56 may be removed from the first sheet feed apparatus 40C as shown in FIG. 13.

Figure 14:
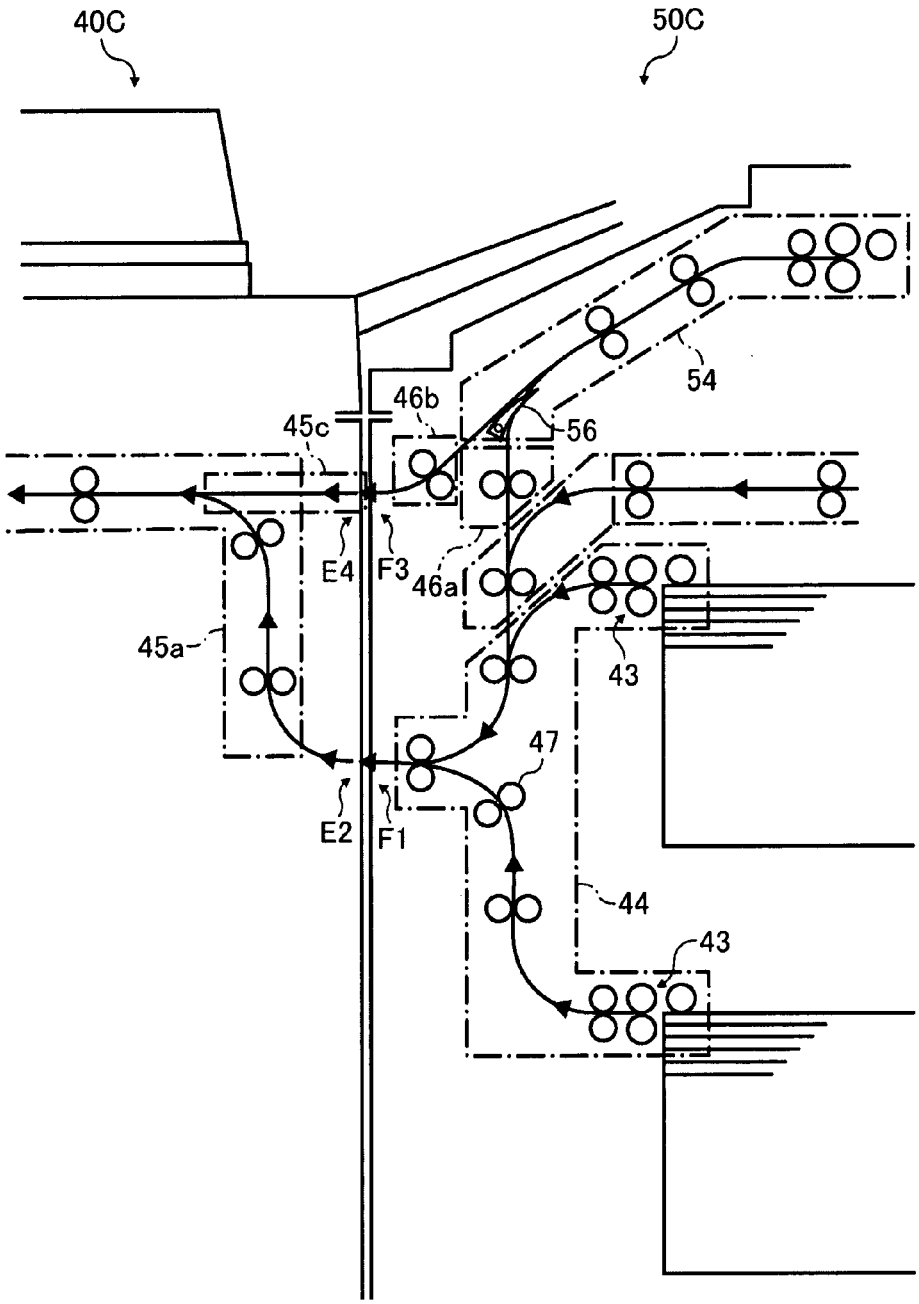
FIG. 14 is a schematic enlarged view (according to an example embodiment of the present invention) of sheet transport route at a connection portion between a first and second sheet feed apparatus.

Such first sheet feed apparatus 40C and second sheet feed apparatus 50C may be connected or coupled as shown in FIG. 14. FIG. 14 shows an expanded view of a connection configuration between the first and second sheet feed apparatuses 40C and 50C.

As shown in FIG. 14, the sheet receiving port E2 of the first sheet feed apparatus 40C may be connected to the sheet transporting port F1 of the second sheet feed apparatus 50C.

Furthermore, as shown in FIG. 14, the sheet receiving port E4 of the first sheet feed apparatus 40C may be connected to the sheet transporting port F3 of the second sheet feed apparatus 50C.

When the changeover pawl 56 in the second sheet feed apparatus 50C may be switched to a position shown in FIG. 14, a sheet, fed from the manual sheet feed unit 51, may be transported to the transport route 45*c* of the first sheet feed apparatus 40C via the transport route 54 and transport route 46*b* in the second sheet feed apparatus 50C.

Accordingly, a sheet placed on the manual sheet feed unit 51 may be transported to the second sheet transport route 45 to the first sheet feed apparatus 40C, and further transported to the image forming apparatus 10, connected to the first sheet feed apparatus 40C.

In such sheet transport operation, a sheet placed on the manual sheet feed unit 51 may be transported to the first sheet feed apparatus 40C without passing through the transport route 46*a* and first sheet transport route 44.

Such sheet transport operation may reduce inflection points in a sheet transport route, by which a variety of sheets (e.g., thicker sheet) may be transported effectively, and sheet transport reliability may be enhanced.

Furthermore, such sheet transport operation shown in FIG. 14 may reduce a distance of sheet transport route starting from the manual sheet feed unit 51, by which a sheet transport control operation may be simplified, thereby a sheet transport reliability may be enhanced.

If a sheet placed on the manual sheet feed unit 51 is transported along the transport route 46*a* and first sheet transport route 44 instead of the transport route 46*b*, such sheet may be transported in a longer distance.

For example, such sheet may be transported in a longer distance compared to a sheet transported from any one of sheet cassettes 41 and 42.

If the sheet placed on the manual sheet feed unit 51 may be transported along the transport route 46*a* and first sheet transport route 44, a controller (not shown) may need to set a pick-up timing of sheet earlier than an image forming timing in the image forming apparatus 10 in some cases.

In such cases, the controller (not shown) may need to set a transport controlling condition, different from a transport controlling condition used when feeding a sheet from the sheet cassettes 41 and 42. Such situation may not be preferable because the controller may need to implement a complex control program for sheet transport operation.

If a distance of sheet transport route may be set shorter by using the transport route 46*b*, the controller (not shown) may control a pick-up timing of sheet placed on the manual sheet feed unit 51 with a similar pick-up timing of sheet fed from the sheet cassette 41 or 42, by which the controller may not need to implement a complex control program for sheet transport operation.

Hereinafter, another example of the first sheet feed apparatus 40 and second sheet feed apparatus 50 is explained with reference to FIGS. 15 and 16.

The transport route 45*a* and 45*c* can be removed from the second sheet feed apparatus 50C shown in FIG. 12, by which a sheet feed apparatus may be manufactured with a relatively lower cost.

In one case, if the image forming apparatus 10 is connected to only one sheet feed apparatus 50C, such second sheet transport route 45 may not be required.

In another case, if a plurality of sheet feed apparatuses 50C are connected or coupled to the image forming apparatus 10, a sheet feed apparatus, which is farthest from the image forming apparatus 10 may not need the transport routes 45*a* and 45*c*.

Figure 15:
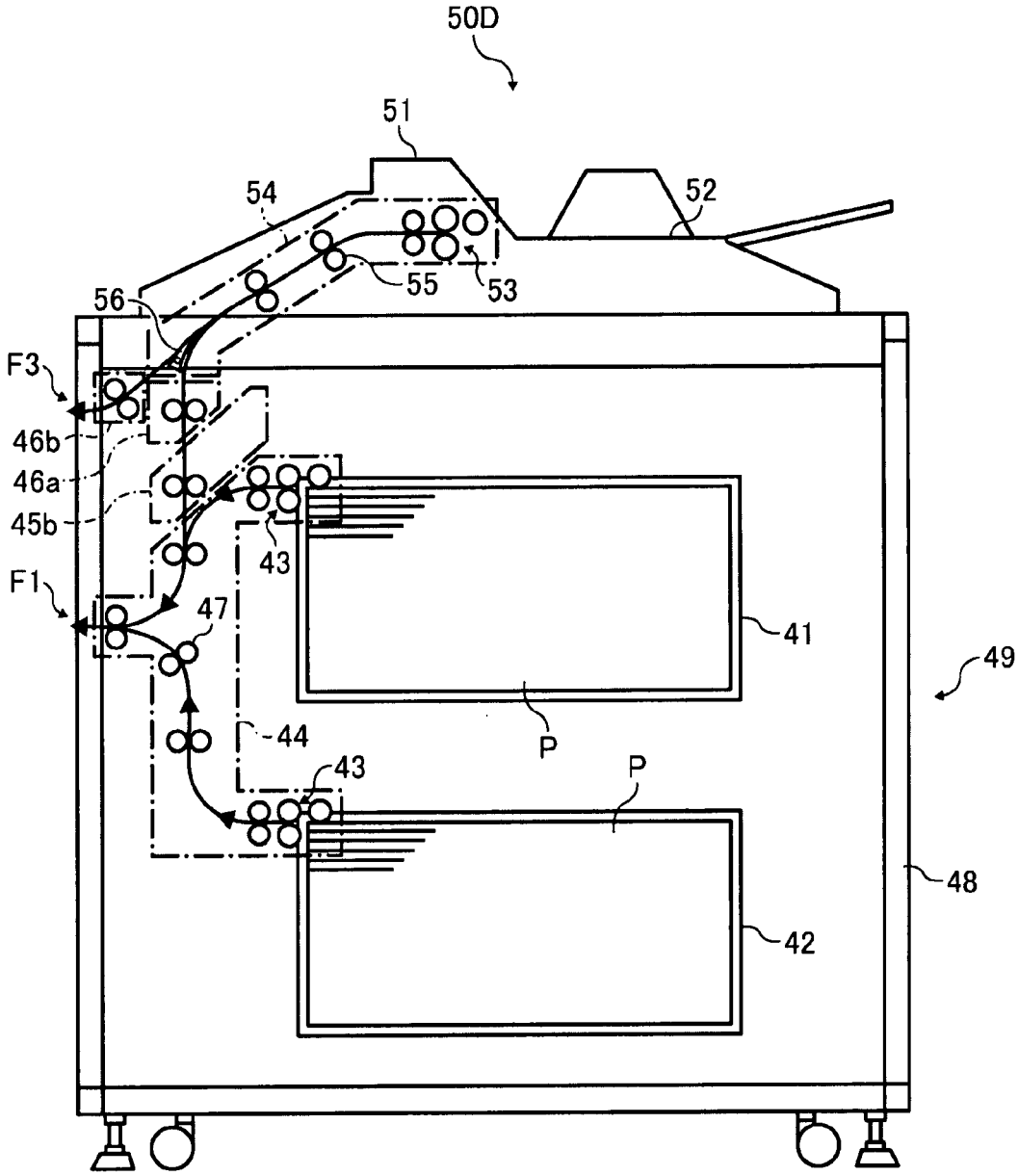
FIG. 15 is a schematic cross-sectional view (according to an example embodiment of the present invention) of another second sheet feed apparatus.

FIG. 15 shows a second sheet feed apparatus 50D having no transport routes 45*a* and 45*c*, which are a part of the second transport route 45.

Except for removing the transport routes 45*a* and 45*c*, the second sheet feed apparatus 50D may have a similar configuration of the second sheet feed apparatus 50C shown in FIG. 12.

Furthermore, if a sheet placed on the manual sheet feed unit 51 can be transported and fed along the transport route 46*b* (of second sheet feed apparatus 50C) and 45*c* (of first sheet feed apparatus 40C) explained with FIG. 14, the second transport route 45 as a whole can be removed from the second sheet feed apparatus 50C.

Figure 16:
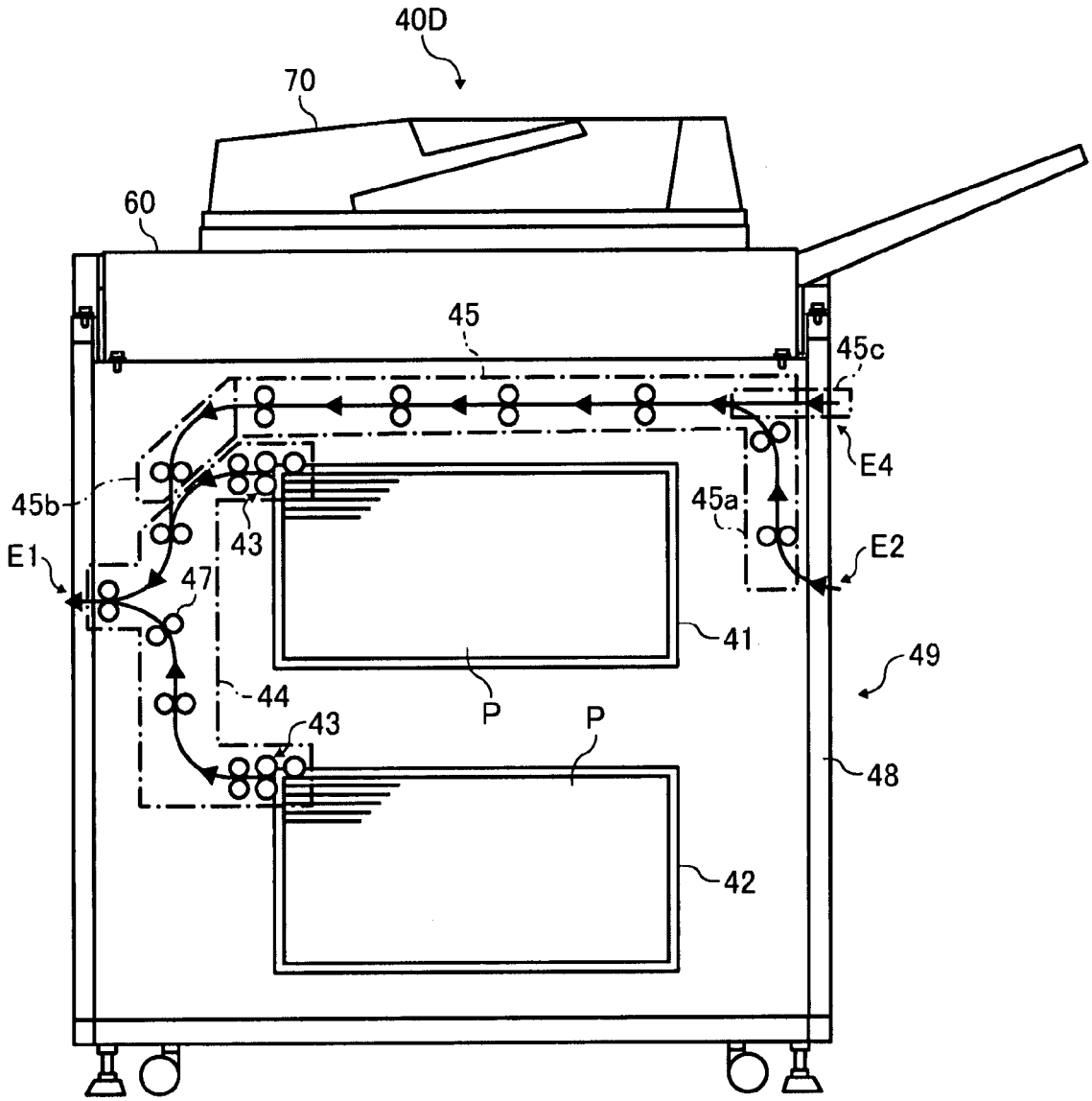
FIG. 16 is a schematic cross-sectional view (according to an example embodiment of the present invention) of another first sheet feed apparatus.

FIG. 16 shows a first sheet feed apparatus 40D having a configuration similar to the first sheet feed apparatus 40C shown in FIG. 13 except removing the third sheet transport route 46 in the first sheet feed apparatus 40C.

The first sheet feed apparatus 40D may not need the third sheet transport route 46 because the image scanner 60 and ADF 70 placed on the first sheet feed apparatus 40D may not transport a recording medium such as sheet to the body unit 49.

In one case, if the image forming apparatus 10 is connected to only one first sheet feed apparatus 40D, such second sheet transport route 45 may not be required.

In another case, if a plurality of first sheet feed apparatuses 40D are connected or coupled to the image forming apparatus 10, a first sheet feed apparatus, which is farthest from the image forming apparatus 10 may not need the transport route 45.

Accordingly, the transport routes 45*a* and 45*c* or second transport route 45 as a whole can be removed from the first sheet feed apparatus 40D in some cases.

In general, an image forming apparatus (e.g., printer) may include a registration correcting mechanism for correcting a sheet orientation in a transport route. The registration correcting unit may correct a sheet position, in a direction perpendicular to a sheet transporting direction.

In general, an image forming apparatus (e.g., printer) may also include a roller disengagement mechanism with the registration correcting mechanism to effectively conduct a registration correcting operation.

The roller disengagement mechanism may disengage a roller from a sheet to set the sheet in a free condition, in which a transport roller may not contact the sheet so that a registration correcting operation can be conducted.

In a conventional image forming apparatus having such registration correcting mechanism and roller disengagement mechanism, a number of transport rollers having roller disengagement mechanism may be increased to conduct a registration correcting operation for a large-sized sheet.

Accordingly, a size of image forming apparatus may become greater, and a size of related parts such as outer cover may also become greater, by which a manufacturing cost of image forming apparatus may be unfavorably increased.

Furthermore, the greater the size of image forming apparatus, the greater the occupying area of apparatus.

In an example embodiment, a registration correcting operation for large-sized sheet may be conducted with an image forming apparatus and sheet feed apparatus connected or coupled to the an image forming apparatus.

Figure 17:
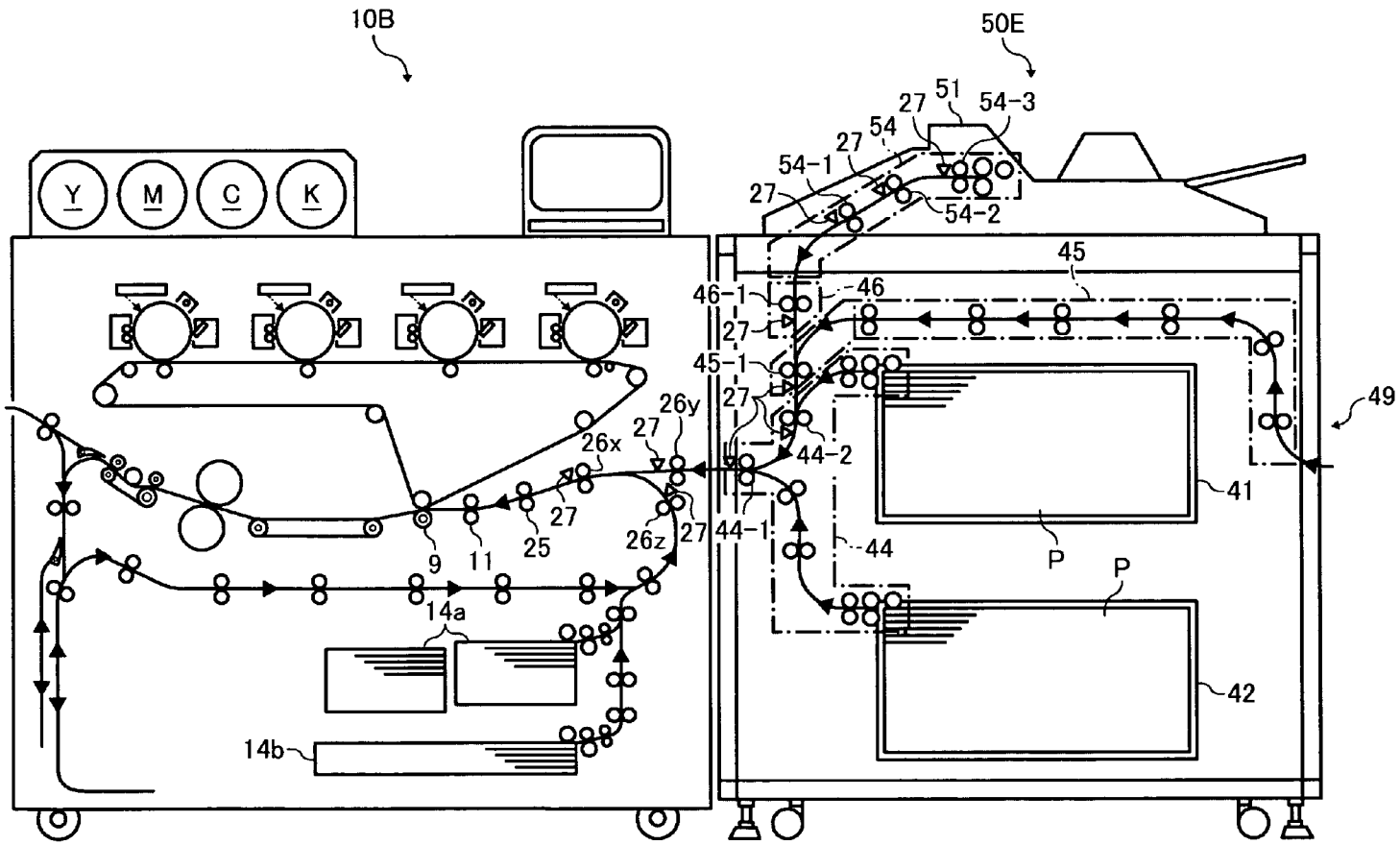
FIG. 17 is a schematic view (according to an example embodiment of the present invention) of image forming system, in which a second sheet feed apparatus is connected to an image forming apparatus.

FIG. 17 shows an image forming system having an image forming apparatus 10B and a second sheet feed apparatus 50E connected to the image forming apparatus 10B.

The image forming apparatus 10B may have a configuration substantially similar to the image forming apparatus 10 shown in FIG. 2.

The second sheet feed apparatus 50E may have a configuration substantially similar to the second sheet feed apparatus 50 to 50D explained in the above.

As shown in FIG. 17, the image forming apparatus 10B may include a transport roller 25 and a registration roller 11, in which the transport roller 25 may be a transport roller closest to the registration roller 11 in an upstream side of registration roller 11.

The transport roller 25 may be provided with a registration correcting mechanism (not shown). The registration correcting mechanism may include a known mechanism such as jogger type and slanted roller type, for example.

The image forming apparatus 10B may also include transport rollers 26*x*, 26*y*, and 26*z* in an upstream side of the transport roller 25.

Such transport rollers 26*x*, 26*y*, and 26*z* may include a roller detaching unit 28 shown in FIG. 18.

Furthermore, each of the transport rollers 26*x* to 26*z* may be provided with a sheet sensor 27 in a downstream side of the transport rollers 26*x* to 26*z* as shown in FIG. 17.

Figure 18A:
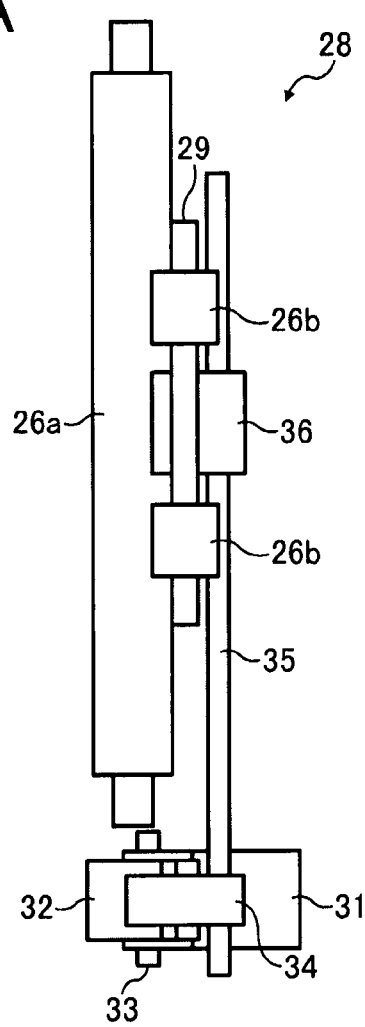
FIGS. 18A and 18B show a plan view and a side view of a roller detaching unit (according to an example embodiment of the present invention) for a transport roller.
Figure 18B:
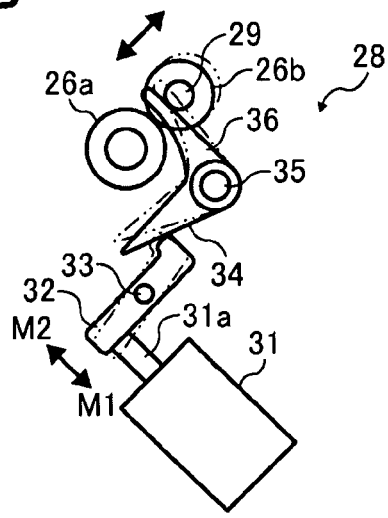

FIG. 18A is a plan view of the roller detaching unit 28, and FIG. 18B is a front view of the roller detaching unit 28.

In an example embodiment, each of the transport roller 26*x* to 26*z* may include a drive-roller 26*a* and a driven-roller 26*b*.

The roller detaching unit 28 may engage/disengage the driven-roller 26*b* to the drive-roller 26*a*.

As shown in FIG. 18, the roller detaching unit 28 may include a solenoid 31 connected to an arm 31*a*. An edge of the arm 31*a* may be connected at one end of a moving member 32, which may be movable for a given range around a center of shaft 33.

Another end of the moving member 32 may be contacted to a pawl 34. The pawl 34 may be fixed to a shaft 35, and the pawl 34 may be movable for a given range around the shaft 35.

A pressure member 36 may also be attached to the shaft 35. The pressure member 36 may be movable for a given range around the shaft 35.

An edge of the pressure member 36 may contact with a roller shaft 29 of the driven-roller 26*b*. Furthermore, the driven-roller 26*b* may be pressed toward the drive-roller 26*a* by a biasing member (not shown).

When a power is supplied to the solenoid 31, the arm 31*a* may move in a direction shown by an arrow M1, by which the moving member 32 may pivot its position to a double-dashed line position shown in FIG. 18B.

Then, the edge of the moving member 32 may push the pawl 34 to pivot the pawl 34 to a position shown by a double-dashed line.

With such pivoting of pawl 34, the shaft 35 may rotate to pivot the pressure member 36 to a position shown by a double-dashed line.

The roller shaft 29 may be pressed by such pivoting of pressure member 36, by which the driven-roller 26*b* may be disengaged from the drive-roller 26*a*.

When a power-supply to the solenoid 31 is set to OFF, the biasing member (not shown) may press the driven-roller 26*b*, by which each member shown in FIG. 18B may be returned to an initial condition show by a solid line, and the driven-roller 26*b* may be engaged to the drive-roller 26*a*.

As similar to the above-explained example embodiments, the second sheet feed apparatus 50E may include the first, second, and third sheet transport routes 44, 45 and 46, in which a given number of transport rollers may be disposed, as required.

The manual sheet feed unit 51 may include the sheet transport route 54, in which transport rollers 54-1 to 54-3 may be disposed.

The second sheet feed apparatus 50E may include transport rollers 44-1, 44-2, 45-1, 46-1 and the manual sheet feed unit 51 may include transport rollers 54-1 to 54-3, and the roller detaching unit 28 shown in FIG. 18 may be provided to each of these rollers.

Furthermore, each of such transport rollers may be provided with a sheet sensor 27 in a downstream side of each of the transport rollers.

In such configured image forming system, the registration correcting mechanism may conduct a registration correcting operation of sheet when conducting an image forming operation.

During a registration correcting operation, the roller detaching unit 28 may be operated by supplying a power to the solenoid 31.

Specifically, the driven-roller 26*b* may be disengaged from the drive-roller 26*a* for each of transport rollers 26*x* to 26*z* in the image forming apparatus 10B, or for each of transport rollers 26*x* to 26*z* in the image forming apparatus 10B and transport rollers 44 and 54 in the second sheet feed apparatus 50E.

With such disengaging operation, a registration correcting operation may be conducted effectively.

When the registration correcting operation is completed, the solenoid 31 may be turned to OFF condition to engage the driven-roller 26*b* to the drive-roller 26*a* again.

In such configuration, the registration correcting operation may be completed when the sheet sensor 27 provided for each transport roller may detect a passing movement of sheet at each transport roller.

In some registration correcting operations, the roller detaching unit 28 provided for transport rollers in the second sheet feed apparatus 50E may be set to OFF condition.

For example, when a sheet is fed from the sheet cassette 14*a* or 14*b* in the image forming apparatus 10B, a registration correcting operation may be conducted only in the image forming apparatus 10B. Such registration correcting operation may be conducted in the image forming apparatus 10B when a size of sheet fed from the second sheet feed apparatus 50E may be within a given size for registration correcting operation, which can be conducted with the image forming apparatus 10B.

In such case, the roller detaching unit 28 for transport rollers in the second sheet feed apparatus 50E may not be operated. From a viewpoint of energy saving and enhancing a life time of parts, the roller detaching unit 28 for transport roller in the second sheet feed apparatus 50E may be set to OFF condition in such cases.

As shown in FIG. 17, the second sheet feed apparatus 50E may include sheet cassettes 41 and 42, which can store a large-sized sheet compared to the sheet cassette 14*a* and 14*b* in the image forming apparatus 10B. Furthermore, the manual sheet feed unit 51 can be used to feed a large-sized sheet.

In an image forming system according to example embodiments, if a large-sized sheet, which cannot be sufficiently corrected as to its registration only by the image forming apparatus 10B, is fed from the sheet cassette 41 and 42 and manual sheet feed unit 51, the roller detaching unit 28 for transport rollers 26*x* to 26*z* in the image forming apparatus 10B and the roller detaching unit 28 for transport roller 44 and 54 in the second sheet feed apparatus 50E may be operated to disengage the driven-roller 26*b* from the drive-roller 26*a*. The roller detaching unit 28 may be operated by activating the solenoid 31.

Accordingly, an image forming system according to example embodiments may conduct a registration correcting operation to a large-sized sheet effectively with the image forming apparatus 10B and the second sheet feed apparatus 50E.

For example, if a large-sized sheet (e.g., 2-meter size) may be fed from the manual sheet feed unit 51, the driven-roller 26*b* may be disengaged from the drive-roller 26*a* for each transport roller in the image forming apparatus 10B and second sheet feed apparatus 50E, provided in a upstream side of the transport roller 25, during a registration correcting operation, in which the sheet may be in a free condition.

Accordingly, a registration correcting operation may be conducted and an image forming operation may be conducted.

Furthermore, because a registration correcting operation for large-sized sheet may be conducted with the image forming apparatus 10B and the second sheet feed apparatus 50E connected to the image forming apparatus 10B, the image forming apparatus 10B may not be required to increase its size (e.g., width direction).

Accordingly, a size of parts such as outer cover for image forming apparatus may be suppressed to a given size level, by which an image forming system for large-sized sheet can be manufactured with a relatively lower cost.

Furthermore, such image forming apparatus and image forming system may reduce or suppress an occupying space by apparatus.

In example embodiment, a number of sheet cassettes in one apparatus may be set to any number such as three, for example.

The sheet transport route (or interlinking transport route) can be disposed at any portion of apparatus including a top portion of apparatus. For example, a sheet transport route may be disposed at a space between a plurality of sheet cassettes.

Furthermore, the first sheet feed apparatus and second sheet feed apparatus may be arranged in any order, as required, and a number of sheet feed apparatus connected or coupled to the image forming apparatus may be set any value, as required.

Furthermore, a unit for enhancing a functionality of image forming apparatus may include a sheet feed apparatus, an image scanner, an automatic document feeder (ADF), a manual sheet feed unit, and other units. For example, an editor panel for editing a relatively higher resolution image, and greater-sized display unit may be added as a unit for enhancing a functionality of image forming apparatus.

The image forming apparatus may conduct an image forming operation with any image forming methods. For example, a color image forming apparatus may employ a direct transfer method for tandem type, a rotary developing unit method, and a method of one image carrying member surrounded by a plurality of developing units.

Furthermore, the image forming apparatus may include a monochrome image forming apparatus. The fixing unit and optical writing unit may also employ any configuration, as required. Furthermore, the image forming method may include any method such as electrophotography, and inkjet method. Furthermore, the image forming applauds may include a facsimile function.

Numerous additional modifications and variations are possible in light of the above teachings. It is therefore to be understood that within the scope of the appended claims, the disclosure of the present invention may be practiced otherwise than as specifically described herein.

What is claimed is:

1. A sheet feed apparatus comprising:

a main frame;

a storage unit mounted on the main frame and configured with a capacity to store a quantity of sheets;

a transporter mounted on the main frame and configured to supply the sheets through a sheet transporting port of the sheet feed apparatus so as to exit the main frame, wherein the sheet transporting port is horizontally coupled to a sheet receiving port;

a supporting frame mounted on the main frame, the supporting frame including a holding member; and an additional unit mounted on the supporting frame and operable to enhance a functionality of the sheet feed apparatus, the additional unit configured so as to sit within a front, side, and rear periphery of the main frame based on a plan view such that an entire bottom face of the additional unit is above a lower surface of the holding member but below an upper surface of the main frame.

2. The sheet feed apparatus according to claim 1, wherein the additional unit includes an image scanner.

3. The sheet feed apparatus according to claim 2, wherein the image scanner is provided with an automatic document feeder.

4. The sheet feed apparatus according to claim 3, wherein the holding member is configured to be inserted inside the sheet feed apparatus, the holding member holds the image scanner by positioning a bottom face of the image scanner lower than a top face of the main frame of the sheet feed apparatus when the image scanner is attached to the supporting frame.

5. The sheet feed apparatus according to claim 3, wherein the supporting frame includes an attachment member fixed to the main frame, and the attachment member is attached with a hinge of the automatic document feeder.

6. The sheet feed apparatus according to claim 1, wherein the additional unit is mountable on the supporting frame in the same manner as the additional unit is mountable on the main frame.

7. The sheet feed apparatus according to claim 1, wherein outer sidewalls of the additional unit are completely bounded by inner sidewalls of the main frame.

8. An image forming system comprising:

an image forming apparatus; and a sheet feed apparatus, horizontally coupled to the image forming apparatus, including at least the following, a main frame, a storage unit mounted on the main frame and configured with a capacity to store a quantity of sheets, a transporter mounted on the main frame and configured to supply the sheets through a sheet transporting port of the sheet feed apparatus so as to exit the main frame and feed into a sheet receiving port of the image forming apparatus, wherein the sheet transporting port is horizontally coupled to the sheet receiving port, a supporting frame mounted on the main frame, the supporting frame including a holding member, and an additional unit mounted on the supporting frame and operable to enhance a functionality of at least one of the sheet feed apparatus and the image forming apparatus, the additional unit configured so as to sit within a front, side, and rear periphery of the main frame based on a plan view such that an entire bottom face of the additional unit is above a lower surface of the holding member but below an upper surface of the main frame.

9. The image forming system according to claim 8, wherein the additional unit includes an image scanner.

10. The image forming system according to claim 9, wherein the image scanner is provided with an automatic document feeder.

11. The image forming system according to claim 10, wherein the holding member is configured to be inserted inside the sheet feed apparatus, the holding member holds the image scanner by positioning the bottom face of the image scanner lower than a top face of the main frame of the sheet feed apparatus when the image scanner is attached to the supporting frame.

12. The image forming system according to claim 10, wherein the supporting frame includes an attachment member fixed to the main frame, and the attachment member is attached with a hinge of the automatic document feeder.

13. The image forming system according to claim 8, wherein:

the sheet feed apparatus is a first sheet feed apparatus; and the image forming system further comprises a second sheet feed apparatus disposed at close proximity in a horizontal arrangement with the first sheet feed apparatus, the second sheet feed apparatus being configured without a supporting frame;

the supporting frame of the first sheet feed apparatus being configured to dispose at least one structure of the first sheet feed apparatus at a different elevation than at least one structure of the second sheet feed apparatus, respectively, so as to facilitate closer proximity of the horizontal arrangement.

14. The image forming system according to claim 8, wherein the additional unit is mountable on the supporting frame in the same manner as the additional unit is mountable on the main frame.

15. A sheet feed apparatus, comprising:

a main frame having a sheet receiving port and a sheet transporting port;

a storage unit within the main frame and configured to store a quantity of sheets;

a transporter arranged within the main frame to provide at least a first sheet path from the storage unit to the sheet transporting port and a second sheet path from the sheet receiving port to the sheet transporting port, the second sheet path extending through a full body dimension of the sheet feed apparatus and configured to facilitate the passage of sheets from an adjacent sheet feed apparatus to the sheet transporting port, the transporter configured to supply the sheets through the sheet transporting port of the sheet feed apparatus so as to exit the main frame, a supporting frame on the main frame, the supporting frame including a holding member; and an additional unit mounted on the supporting frame and configured to enhance a functionality of the sheet feed apparatus, the additional unit configured so as to sit within a front, side, and rear periphery of the main frame based on a plan view such that an entire bottom face of the additional unit is above a lower surface of the holding member but below an upper surface of the main frame.

16. The sheet feed apparatus according to claim 15, wherein the additional unit includes an image scanner.

17. The sheet feed apparatus according to claim 16, wherein the image scanner is provided with an automatic document feeder.

18. The sheet feed apparatus according to claim 17, wherein the holding member is configured to be inserted inside the sheet feed apparatus, the holding member holds the image scanner by positioning the bottom face of the image scanner lower than a top face of the main frame of the sheet feed apparatus when the image scanner is attached to the supporting frame.

19. The sheet feed apparatus according to claim 17, wherein the supporting frame includes an attachment member fixed to the main frame, and the attachment member is attached with a hinge of the automatic document feeder.

20. The sheet feed apparatus according to claim 15, wherein the additional unit is mountable on the supporting frame in the same manner as the additional unit is mountable on the main frame.

* * * * *